US010704430B2

(12) United States Patent
Bohner et al.

(10) Patent No.: US 10,704,430 B2
(45) Date of Patent: Jul. 7, 2020

(54) CAM SHAFT PHASE SETTER COMPRISING AN ANNULAR REFLUX VALVE

(71) Applicant: Schwäbische Hüttenwerke Automotive GmbH, Aalen-Wasseralfingen (DE)

(72) Inventors: Jürgen Bohner, Bad Waldsee (DE); Uwe Meinig, Bad Saulgau (DE)

(73) Assignee: Schwäbische Hüttenwerke Automotive GmbH, Aalen-Wasseralfingen (DE)

( * ) Notice: Subject to any disclaimer, the term of this patent is extended or adjusted under 35 U.S.C. 154(b) by 0 days.

(21) Appl. No.: 16/202,714

(22) Filed: Nov. 28, 2018

(65) Prior Publication Data

US 2019/0162084 A1 May 30, 2019

(30) Foreign Application Priority Data

Nov. 28, 2017 (DE) ..... 10 2017 011 004

(51) Int. Cl.
*F01L 1/344* (2006.01)

(52) U.S. Cl.
CPC ... *F01L 1/3442* (2013.01); *F01L 2001/34426* (2013.01); *F01L 2001/34433* (2013.01);
(Continued)

(58) Field of Classification Search
CPC ..... F01L 1/3442; F01L 2001/34423; F01L 2001/34426; F01L 2001/3443;
(Continued)

(56) References Cited

U.S. PATENT DOCUMENTS 9,200,546 B2 12/2015 Meinig et al.
2005/0103297 A1 5/2005 Simpson
(Continued)

FOREIGN PATENT DOCUMENTS

DE 102007035671 A1 1/2009
DE 102013219405 A1 4/2014
(Continued)

OTHER PUBLICATIONS

German Search Report for German Application No. 10 2017 011 004.2, dated Sep. 28, 2018, with partial translation—11 pages.
(Continued)

*Primary Examiner* — Jorge L Leon, Jr.
(74) *Attorney, Agent, or Firm* — RatnerPrestia

(57) ABSTRACT

A phase setter for adjusting the rotational angular position of a cam shaft relative to a crankshaft of an internal combustion engine. The phase setter includes a stator; a rotor which together with the stator forms a first and second pressure chambers; a control valve featuring a pressure port, and first and second working ports; a feed for the inflow of pressure fluid to the pressure port, a first connecting channel connecting the first pressure chamber to the first working port, and a second connecting channel connecting the second pressure chamber to the second working port; and a reflux valve device acts in the feed and includes a valve structure extending annularly around the rotational axis and has one or more spring tongues or can be axially moved to restrict backflow of pressure fluid through the feed more significantly than the inflow of pressure fluid to the pressure port.

19 Claims, 13 Drawing Sheets

(52) U.S. Cl.
CPC ..... *F01L 2001/34446* (2013.01); *F01L 2001/34453* (2013.01); *F01L 2001/34463* (2013.01); *F01L 2001/34479* (2013.01); *F01L 2001/34483* (2013.01); *F01L 2101/00* (2013.01); *F01L 2103/00* (2013.01); *F01L 2250/04* (2013.01); *F01L 2820/031* (2013.01)

(58) Field of Classification Search
CPC ..... F01L 2001/34433; F01L 2001/3444; F01L 2001/3445; F01L 2001/34479; F01L 1/46
USPC ..... 123/90.15, 90.17
See application file for complete search history.

(56) References Cited

U.S. PATENT DOCUMENTS

2006/0086332 A1* 4/2006 Simpson ..... F01L 1/022 123/90.17
2008/0264200 A1* 10/2008 Hoppe ..... F01L 1/34 74/568 R
2011/0114047 A1 5/2011 Hohmann et al.
2014/0090612 A1 4/2014 Hayashi et al.
2015/0034032 A1* 2/2015 Ikuma ..... F01L 1/3442 123/90.15
2015/0292369 A1* 10/2015 Hayashi ..... F01L 1/3442 123/90.12
2016/0010516 A1* 1/2016 Suzuki ..... F03C 2/30 123/90.12
2016/0169060 A1* 6/2016 Fischer ..... F01L 1/3442 123/90.17
2018/0106167 A1* 4/2018 Camilo ..... F01L 1/3442

FOREIGN PATENT DOCUMENTS

DE 102015104113 A1 10/2015
EP 2322769 A1 5/2011
EP 2463486 A2 6/2012
WO 2017088859 A1 6/2017

OTHER PUBLICATIONS

Extended European Search Report for European Application No. 18 209 011.8, dated Apr. 4, 2019, 10 pages.

* cited by examiner

CAM SHAFT PHASE SETTER COMPRISING AN ANNULAR REFLUX VALVE

CROSS-REFERENCE TO RELATED APPLICATIONS

This application claims priority to German Patent Application No. 10 2017 011 004.2, filed Nov. 28, 2017, the contents of such application being incorporated by reference herein.

FIELD OF THE INVENTION

The invention relates to a cam shaft phase setter for adjusting the rotational angular position of a cam shaft relative to a crankshaft of an internal combustion engine.

BACKGROUND OF THE INVENTION

Hydraulic cam shaft phase setters which are actuated by the engine lubricating oil pressure—hereinafter "phase setters"—have become widespread in motor vehicle construction, a preferred area of application for the invention, not least because of their reliable, robust design and favourable cost-benefit relationship. They do however have a certain design disadvantage over electromechanical phase setters, in that the adjusting speed is limited at low oil temperatures due to the limited oil pressure and high oil viscosity. In order to increase the adjusting speed in hydraulic phase setters, there is an endeavour to derestrict the flow cross-sections of the channels which guide oil to and in the phase setter. Alternatively or additionally, oil pressure storages and hydraulic designs are used in which, in order to rapidly adjust the rotational angular position of the cam shaft relative to the crankshaft, the unequal cam shaft torques are used to guide some of the oil from pressure chambers of the phase setter which are to be evacuated, directly—i.e. by bypassing the control valve—via reflux valves, into pressure chambers of the phase setter which are to be filled.

EP 2 463 486 B1, incorporated by reference herein, describes an advantageous design for a phase setter comprising a pressure storage. A direct oil flow between the pressure chambers of the phase setter, assisted by the cam shaft torque, is known for example from US 2005/0103297 A1, incorporated by reference herein.

The use of pressure storages is generally associated with a greater effort in construction. In the restricted construction spaces of modern drive motors, incorporating the pressure storage into the design causes significant problems. Using the cam shaft torques by directly connecting the pressure chambers which are to be evacuated to the pressure chambers which are to be filled requires a substantially greater effort in construction due to the additional connecting channels which have to be provided in the phase setter and the reflux valves which are arranged in said channels. The channel routing in the phase setter is complex. In accordance with the small construction size of the phase setters, the additionally required connecting channels can only be embodied with small flow cross-sections and/or a sharp flow deflection. The reflux valves required for controlling the direct oil flow produce additional pressure losses. The comparatively large number of reflux valves required increases the likelihood of components failing. A damaged or broken reflux valve makes it more difficult to set the phase angle and/or is associated with a substantial increase in the oil consumption of the phase setter, since a direct oil flow between pressure chambers which is enabled by a broken reflux valve has to be compensated for by constantly replenishing oil via the control valve of the phase setter. Because the pressure chambers which are to be evacuated are directly connected to the pressure chambers which are to be filled, it becomes more difficult to vent the phase setter for example after the engine is started.

In order to prevent oil from being able to flow from the pressurised pressure chambers back towards the oil supply system, reflux valves are arranged in the oil feed, upstream of the control valve of the phase setter. Preventing backflow through the feed is a prerequisite for high setting speeds and in particular low response times when phase adjustments are required. As described above with respect to the reflux valves provided at other locations, installing reflux valves does however increase the complexity of the phase setter and increases the flow resistance in the feed. Flutter valves are favourable with regard to the effort in construction and the flow resistance. For instance, valve structures which extend annularly around the rotational axis of the phase setter and comprise multiple spring tongues which are elastically flexible axially and arranged in a distribution in a circumferential direction are for example known from US 2016/0010516 A1 and WO 2017/088859 A1, which are incorporated by reference herein. In the phase setter of US 2016/0010516 A1, the valve structure and an annular filter disc are packed in between sheet-metal lamellae of a stack of lamellae. The stack of lamellae is fastened to a facing end of a rotor of the phase adjuster by means of pressure pins. The pressure pins serve to position the rotor on the facing end of a cam shaft. The stack of lamellae comprises many parts and is laborious to fit. The costs involved in providing and fitting the reflux valves are correspondingly high. In the phase setter of WO 2017/088859 A1, the valve structure is clamped between a stator ring and a stator cover and opens directly into the pressure chambers in order to equalise oil losses therein.

SUMMARY OF THE INVENTION

An aspect of the invention is a phase setter which operates at a high adjusting speed and which is favourable with regard to its complexity and the effort which has to be expended in producing and fitting its components.

An aspect of the invention proceeds on the basis of a phase setter for adjusting the rotational angular position of a cam shaft relative to a crankshaft of an internal combustion engine, wherein the phase setter comprises: a stator for rotary-driving the phase setter using the crankshaft; and a rotor, which can be rotated relative to the stator about a rotational axis, for outputting onto the cam shaft. In order to output onto the cam shaft, the rotor can be connected to it in a fixed rotational speed relationship and, advantageously, non-rotationally. The stator and the rotor together form one or more first pressure chambers and one or more second pressure chambers which can be charged with a pressure fluid in order to be able to adjust the rotor relative to the stator about the rotational axis and thus adjust the rotational angular position of the rotor relative to the stator. The phase setter can in particular be embodied to have a vane-cell design.

The phase setter comprises a control valve featuring a pressure port, a first working port and a second working port, respectively, for the pressure fluid. The control valve is configured to charge the one or more first pressure chambers with the pressure fluid and simultaneously relieve the one or more second pressure chambers or, selectively, to charge the one or more second pressure chambers with the pressure fluid and relieve the one or more first pressure chambers. When the one or more first pressure chambers are charged with pressure, the rotor is adjusted relative to the stator in one rotational direction, and when the one or more second pressure chambers are charged with pressure, the rotor is adjusted relative to the stator in the other rotational direction. The control valve can optionally be configured to charge the one or more first pressure chambers and the one or more second pressure chambers with the pressure fluid simultaneously, in order to hydraulically block the rotor in a central position relative to the stator.

The control valve can in particular be embodied as a central valve which protrudes centrally through the rotor. A control valve which is embodied as a central valve can simultaneously also serve to fasten the phase setter to the cam shaft and comprises, for this purpose, a valve housing which protrudes axially through the rotor. The valve housing, which is central in relation to the rotor, comprises a housing shaft which protrudes beyond the rotor, towards the cam shaft. The housing shaft comprises a joining portion for joining to the cam shaft, for example a screwing portion for establishing a screw connection. In an end region which protrudes on the side of the rotor facing away from the cam shaft, the valve housing also comprises a radial widening, for example a collar, for exerting an axial pressing force. The rotor can be clamped by such a control valve between the cam shaft and the widening and thus non-rotationally connected to the cam shaft. The widening can in particular form a screw head for axially clamping the rotor unit by means of a screw connection.

The phase setter also comprises a feed for the inflow of pressure fluid to the pressure port, one or more first connecting channels for connecting the one or more first pressure chambers to the first working port, and one or more second connecting channels for connecting the one or more second pressure chambers to the second working port. The feed can consist of one feed channel or can advantageously comprise multiple feed channels arranged in a distribution around the rotational axis.

A reflux valve device comprising a valve structure which extends annularly around the rotational axis is provided in the feed. The rotor and the valve structure are constituents of a rotor unit. In a first embodiment, the valve structure comprises one or more axially movable spring tongues. If the feed comprises multiple feed channels, the valve structure comprises a spring tongue for each of the feed channels, i.e. at least one spring tongue per feed channel. In a second embodiment, the valve structure is spring-loaded and axially movable as a whole. Although, in both embodiments, the valve structure preferably extends completely around the rotational axis, self-contained through 360°, and correspondingly forms a circumferentially closed ring, a "valve structure which extends annularly around the rotational axis" is also understood to be a valve structure which comprises multiple separate annular segments which are arranged around the rotational axis and each comprise one or more spring tongues which extend in a circumferential direction in the shape of an annular segment. The term "annular" thus encompasses embodiments in which the valve structure forms a circumferentially closed ring or a slotted ring and also embodiments in which the valve structure comprises multiple mutually separate valve structure segments which are arranged in a distribution around the rotational axis.

The respective spring tongue in the first embodiment, and the valve structure as a whole in the second embodiment, can be moved back and forth in an axial direction between a minimum flow position and a maximum flow position. If the respective spring tongue in the first embodiment, and the valve structure in the second embodiment, assumes the maximum flow position, the pressure fluid can flow through the feed towards the pressure port. The minimum flow position can in particular be a blocking position in which the respective spring tongue or the valve structure as a whole completely blocks the feed against backflow. In principle, it is however also conceivable for the reflux valve device to allow a small backflow in the minimum flow position, i.e. to not completely block it against backflow but rather to merely restrict it significantly but still leave a small flow cross-section free. The free flow cross-section of the reflux valve device is at any rate significantly smaller in the minimum flow position than in the maximum flow position, such that the backflow is more significantly restricted than the inflow; preferably, a backflow is prevented in the minimum flow position.

In accordance with an aspect of the invention, the valve structure fulfils a first feature and/or a second feature as follows: in accordance with the first feature, the valve structure extends between a first cross-sectional plane, which intersects the pressure port, and a second cross-sectional plane which intersects the second working port, when fluid is not flowing through it; in accordance with the second feature, the feed comprises a downstream feed portion which extends towards the rotational axis up to the pressure port and axially exhibits a distance from the second connecting channel, and the valve structure extends between a cross-sectional plane, which intersects the downstream feed portion, and a cross-sectional plane which intersects the second connecting channel, when fluid is not flowing through it. In preferred embodiments, a combination of the two features is implemented.

The valve structure exhibits an axial distance of greater than zero from each of the first cross-sectional plane and the second cross-sectional plane, when fluid is not flowing through it. Because the valve structure is arranged axially between the first and second cross-sectional plane, a rotor unit comprising the rotor and the valve structure, and therefore also the phase setter as a whole, can be embodied to be axially shorter than known phase setters in which valve structures of the type described are arranged axially next to the working ports and the pressure port on the same side in or on the rotor unit.

The first cross-sectional plane can intersect the pressure port and/or the downstream feed portion at any point axially. The second cross-sectional plane can intersect the second working port and/or the second connecting channel at any point axially. The valve structure which fulfils the first feature can therefore overlap axially with the pressure port and/or the second working port. Preferably, however, it exhibits a non-overlapping axial offset with respect to the pressure port and/or the second working port. The valve structure which fulfils the second feature can overlap axially with the downstream feed portion and/or the second connecting channel. Preferably, however, it exhibits a non-overlapping axial offset with respect to the downstream feed portion and/or the second connecting channel. In its path to the valve structure, the feed can pass the second connecting channel at an offset in a circumferential direction within the rotor unit.

In preferred embodiments, the valve structure fulfils a third feature and/or a fourth feature as follows: in accordance with the third feature, the valve structure extends between a cross-sectional plane, which intersects the first working port, and a cross-sectional plane which intersects the second working port, when fluid is not flowing through it; in accordance with the fourth feature, the valve structure extends between a cross-sectional plane, which intersects the first connecting channel, and a cross-sectional plane which intersects the second connecting channel, when fluid is not flowing through it. In preferred embodiments, a combination of the third feature and the fourth feature is implemented.

The pressure port can in particular be arranged axially between the first working port and the second working port. If the pressure port is situated in an axially different arrangement axially next to the first and second working port on the same side, an aspect of the invention can be implemented in a modified form such that the valve structure fulfils the third feature and/or the fourth feature, whereas the first feature and/or the second feature is/are merely optional.

If the valve structure comprises one or more spring tongues, the rotor and the valve structure—in an embodiment consisting of one or also more parts—can be directly joined in a positive and/or frictional fit. The valve structure which preferably consists of one part, or each of the segments of a valve structure which consists of multiple parts, can thus for example be clipped or fixed to the rotor.

In preferred embodiments, the phase setter comprises a holding device which is connected to the rotor, preferably inserted into an accommodating space of the rotor, and which holds the valve structure in position relative to the rotor. If the phase setter comprises such a holding device, then the holding device can advantageously be a constituent of the rotor unit. Preferably, it is non-rotationally connected to the rotor. The holding device can consist of multiple parts. The holding device preferably consists of one part. In embodiments in which it consists of one part and also in embodiments in which it alternatively consists of multiple parts, the holding device preferably extends annularly around the rotational axis. The term "annularly" has the same meaning in relation to the holding device as it does in relation to the valve structure. The holding device holds the valve structure on an inner end-facing support surface of the rotor unit. The inner end-facing support surface is a surface which points in an axial direction and extends axially between the outer end-facing surfaces which face away from each other at the facing ends of the rotor unit, each at an axial distance from the outer end-facing surfaces. In preferred embodiments, the inner end-facing support surface is an end-facing surface of the rotor or holding device. If the rotor unit comprises another component which is non-rotationally connected to the rotor, said other component can form the inner end-facing support surface on which the valve structure is held by means of the holding device.

If the valve structure comprises one or more spring tongues, the rotor unit can comprise an assigned contact surface for the respective spring tongue, axially opposite the respective spring tongue. It is advantageous if the feed comprises an upstream feed portion which the respective contact surface axially faces across the valve structure, and the pressure fluid flowing through the reflux valve device is deflected towards the rotational axis at the respective spring tongue and/or the assigned contact surface. The pressure fluid particularly advantageously flows off from the contact surface and/or the respective spring tongue towards the rotational axis. In embodiments in which the valve structure comprises one or more spring tongues, the holding device can form the assigned contact surface for the respective spring tongue.

For the purpose of dynamics, in particular switching to a maximum throughflow even at low pressures, it is favourable if the respective spring tongue is formed as a thin spring lamella which yields into the maximum flow position even at a low upstream pressure burden and offers the passing pressure fluid as little resistance as possible. It is advantageous, in particular for such a reflux valve device formed as a Reed valve, if the relevant spring tongue comes to rest on its rear side over an area when moving into the maximum flow position and is thus cleanly supported in the maximum flow position.

In embodiments in which the valve structure as a whole can be moved, counter to a spring force, into the maximum flow position and in which the holding device comprises a supporting body which is inserted into an accommodating space of the rotor, the spring force can advantageously be absorbed in the supporting body of the holding device, such that the flow of spring force in the holding device is closed. The spring force is generated by one or more reflux valve springs which is/are preferably arranged such that it presses or they jointly press the valve structure against an end-facing surface of the holding device, preferably an end-facing surface of the supporting body, in the minimum flow position. In such embodiments, the relevant end-facing surface of the holding device forms the inner end-facing support surface of the rotor unit mentioned. The respective reflux valve spring is supported on a counter bearing which is connected to the supporting body of the holding device, preferably such that it cannot move in a direction of the spring force, wherein it can for example act directly on the valve structure. The counter bearing is understood to be a constituent of the holding device. Alternatively, however, the counter bearing of the respective reflux valve spring can also be supported directly on the rotor.

In order to simplify providing the feed and/or connecting channels in or on the rotor, an insert can be arranged in an accommodating space of the rotor. The insert can in particular form the holding device. In advantageous embodiments, the insert and/or holding device performs multiple functions. A first function, if the insert forms the holding device, is the function of holding the valve structure. In a second function, the insert together with the valve structure, or even without the valve structure, can serve to deflect the pressure fluid radially inwards, towards the rotational axis and preferably towards the pressure port, i.e. it can perform a function of deflecting the pressure fluid, wherein the pressure fluid is deflected from an inflow direction towards the rotational axis by means of the insert, preferably together with the valve structure, in a deflecting portion of the feed.

The deflecting portion of the feed can extend through the insert, such that the fluid is deflected within the insert. More preferably, however, the insert delineates the deflecting portion only laterally, such that the pressure fluid flows past the insert in the deflecting portion, wherein it changes its flow direction. It is advantageous if the insert and the rotor delineate the deflecting portion. The valve structure can form an additional delineating wall of the deflecting portion. The valve structure can in particular be arranged such that the pressure fluid flows onto it and is deflected at the valve structure towards the rotational axis. The valve structure as a whole or the respective spring tongue can then form an axially movable delineating wall at which the pressure fluid is deflected. The fluid is preferably deflected from an inflow direction, which is at least predominantly axial, into an outflow direction which is more significantly radial than the inflow direction and preferably at least predominantly radial.

The feed within the rotor unit can comprise an upstream feed portion which the deflecting portion adjoins. The feed portion can guide the pressure fluid to the deflecting portion, in particular in an axial direction and optionally such that it exhibits a directional component which is tangential with respect to the rotational axis. The feed portion can also in principle extend such that it exhibits a radial directional component, although the pressure fluid is still guided to the reflux valve device and/or the deflecting portion such that it exhibits an at least predominantly axial directional component. If the insert, preferably the holding device, performs the deflecting function together with the valve structure or without the valve structure, the pressure fluid flowing through the deflecting portion is deflected from an at least predominantly axial inflow direction into an outflow direction which is more significantly radial than the inflow direction and preferably at least predominantly radial, by means of the insert, preferably the holding device, and optionally also by means of the valve structure.

As already mentioned, the insert which preferably forms the holding device can be configured to delineate at least one of the connecting channels, i.e. the first and/or second connecting channel, and separate it/them from the feed, such that the insert performs a function of delineating and separating the pressure fluid. If, as is preferred, the phase setter comprises multiple first pressure chambers and multiple second pressure chambers in a distribution around the rotational axis, and a correspondingly number of first connecting channels and second connecting channels, then in preferred embodiments, the insert delineates each of the first connecting channels or each of the second connecting channels. If, as is preferred, the feed to the pressure port in the rotor unit comprises multiple feed channels in a distribution around the rotational axis, then the insert advantageously delineates each of these feed channels. In this context, "delineates" means that the insert completely or merely partially surrounds the respective channel in at least one channel portion, i.e. it forms at least a partial region of the circumferential channel wall of the respective channel.

A holding device or other insert which delineates a deflecting portion in the feed, as described above, preferably together with the rotor, and/or performs a function of delineating and separating functionally different channels of the rotor unit, simplifies the rotor in relation to its channel routing and makes it easier to produce channels which extend in the rotor. Using the rotor unit, it is possible to produce channel geometries which could be established without the insert, merely at greater effort.

The phase setter can comprise a dirt filter in the feed, in order to hold back particles contained in the pressure fluid. In advantageous embodiments, the dirt filter extends around the rotational axis in the shape of a sleeve. If the phase setter comprises an insert which is inserted into an accommodating space of the rotor, the insert can position, for example secure and/or hold and/or support, the dirt filter axially and/or radially and/or tangentially within the rotor unit. The dirt filter can be arranged on the insert such that it surrounds an outer circumference of the insert or is surrounded by an inner circumference of the insert. The dirt filter can be arranged upstream or in particular downstream of the reflux valve device in the feed to the pressure port. It is preferably arranged such that the inflowing pressure fluid flows through the dirt filter from the radially outer side to the radially inner side. It is advantageous if the pressure fluid is fed to the dirt filter such that it exhibits a tangential directional component. If the fluid flows onto the dirt filter such that it exhibits a directional component transverse to a screen surface of the filter, as will be the case if it flows onto it such that it exhibits a tangential directional component, then particles present in the pressure fluid have to be sharply deflected in order to pass the dirt filter, which is made more difficult by the inertia of the particles. This reduces the likelihood that particles will pass the dirt filter, as compared to flowing onto the dirt filter orthogonally with respect to the screen surface.

The insert can be configured to perform one or any two or even more functions, in particular the function of deflecting and/or delineating and separating the pressure fluid and/or the function of positioning and/or holding a dirt filter. The respective functionality can advantageously be implemented in combination with the function of holding the valve structure, or also without this holding function, by means of an insert which is joined to the rotor. The insert can advantageously form the holding device. It can instead however also be provided in addition to the holding device, if the valve structure is held by means of a holding device which is connected to the rotor. The respective functionality is advantageous not only in combination with arranging the valve structure between the pressure port and the second working port and/or between the working ports, but also in its own right. Lastly, an insert of the type mentioned is also advantageous irrespective of the presence or embodiment of a reflux valve device. The Applicant therefore reserves the right to direct claims to a phase setter which for example comprises Features (a) to (d) of claim 1 and one or more features which describe(s) the respective functionality of the insert. Feature (e) and/or Feature (f) and/or Feature (g) of claim 1 can but need not be implemented.

Features of an aspect of the invention are also described in the aspects formulated below. The aspects are worded in the manner of claims and can substitute for them. Features disclosed in the aspects can also supplement and/or qualify the claims, indicate alternatives with respect to individual features and/or broaden claim features. Bracketed reference signs refer to example embodiments of the invention which are illustrated below in figures. The reference signs do not restrict the features described in the aspects to their literal sense as such, but do conversely indicate preferred ways of implementing the respective feature.

Aspect 1. A phase setter for adjusting the rotational angular position of a cam shaft relative to a crankshaft of an internal combustion engine, wherein the phase setter comprises:

(a) a stator (1) for rotary-driving the phase setter using the crankshaft;

(b) a rotor (10) which can be rotated relative to the stator (1) about a rotational axis (R) and can be coupled to the cam shaft (N) in order to drive the cam shaft (N), and which together with the stator (1) forms a first pressure chamber ($K_1$) and a second pressure chamber ($K_2$) which can be charged with a pressure fluid in order to be able to adjust the rotor (10) relative to the stator (1) about the rotational axis (R);

(c) a control valve (20) featuring a pressure port (P), a first working port (A) and a second working port (B), respectively, for the pressure fluid;

(d) a feed (14, 15, 44; 64, 65, 66) for the inflow of pressure fluid to the pressure port (P), a first connecting channel (16) for connecting the first pressure chamber ($K_1$) to the first working port (A), and a second connecting channel (17) for connecting the second pressure chamber ($K_2$) to the second working port (B);

(e) and a reflux valve device (50; 70) which acts in the feed (14, 15, 44; 64, 65, 66) and comprises a valve structure (51; 71) which extends annularly around the rotational axis (R) and which is a constituent of a rotor unit (100; 101) comprising the rotor (10) and the valve structure (51; 71) and which comprises one or more axially movable spring tongues (52) or which can be axially moved in order to restrict a backflow of pressure fluid through the feed (14, 15, 44; 64, 65, 66) more significantly than the inflow of pressure fluid to the pressure port (P).

Aspect 2. The phase setter according to the preceding aspect, wherein the valve structure (51; 71) extends between a cross-sectional plane ($Q_P$), which intersects the pressure port (P), and a cross-sectional plane ($Q_B$) which intersects the second working port (B), when fluid is not flowing through it.

Aspect 3. The phase setter according to any one of the preceding aspects, wherein the valve structure (51; 71) is axially offset, with no overlap, with respect to the pressure port (P) and/or the second working port (B).

Aspect 4. The phase setter according to any one of the preceding aspects, wherein in its path to the valve structure (51; 71), the feed (14, 15, 44; 64, 65, 66) passes the second connecting channel (17) at an offset in a circumferential direction.

Aspect 5. The phase setter according to any one of the preceding aspects, wherein in its path to the valve structure (51; 71), the feed (14, 15, 44; 64, 65, 66) passes the second connecting channel (17) at an offset in a circumferential direction in the rotor unit (100; 101).

Aspect 6. The phase setter according to any one of the preceding aspects, wherein the feed (14, 15, 44) comprises a downstream feed portion (15) which extends towards the rotational axis (R) up to the pressure port (P) and axially exhibits a distance from the second connecting channel (17), and the valve structure (51; 71) extends between a cross-sectional plane ($Q_P$), which intersects the downstream feed portion (15), and a cross-sectional plane ($Q_B$) which intersects the second connecting channel (17), when fluid is not flowing through it.

Aspect 7. The phase setter according to the preceding aspect, wherein the valve structure (51; 71) is axially offset, with no overlap, with respect to the downstream feed portion (15) and/or the second connecting channel (17).

Aspect 8. The phase setter according to any one of the preceding aspects, wherein the first connecting channel (16) and the second connecting channel (17) axially exhibit a distance from each other, and the valve structure (51; 71) extends between a cross-sectional plane ($Q_A$), which intersects the first connecting channel (16), and a cross-sectional plane ($Q_B$) which intersects the second connecting channel (17), when fluid is not flowing through it.

Aspect 9. The phase setter according to the preceding aspect, wherein the valve structure (51; 71) is axially offset, with no overlap, with respect to the first connecting channel (16) and/or the second connecting channel (17).

Aspect 10. The phase setter according to any one of the preceding aspects, wherein the feed (14, 15, 44; 64, 65, 66) and at least one of the connecting channels (16, 17), preferably the first connecting channel (16) and the second connecting channel (17), emerges at an inner circumference (11*a*; 11*a*, 60*a*) of the rotor unit (100; 101).

Aspect 11. The phase setter according to any one of the preceding aspects, wherein the first connecting channel (16) emerges into the first pressure chamber ($K_1$) at an outer circumference (11*c*) of the rotor unit (100; 101), and/or the second connecting channel (17) emerges into the second pressure chamber ($K_2$) at the outer circumference (11*c*) of the rotor unit (100; 101).

Aspect 12. The phase setter according to any one of the preceding aspects, wherein the first connecting channel (16) extends from the first working port (A) up to and into the first pressure chamber ($K_1$), and/or the second connecting channel (17) extends from the second working port (B) up to and into the second pressure chamber ($K_2$), through the rotor unit (100; 101).

Aspect 13. The phase setter according to any one of the preceding aspects, wherein the feed (14, 15, 44) in the rotor unit (100) comprises an upstream feed portion (14) and, adjoining it in a feed direction, a deflecting portion (44) for deflecting the pressure fluid towards an inner circumference (11*a*) of the rotor unit (100), the valve structure (51) comprises multiple spring tongues (52), and the deflecting portion (44) comprises multiple axial recesses (43) which are arranged in a distribution around the rotational axis (R) and spaced from each other in a circumferential direction and into which the spring tongues (52) can axially yield.

Aspect 14. The phase setter according to any one of the preceding aspects, wherein the feed (14, 15, 44; 64, 65, 66) extends such that the pressure fluid flows onto the valve structure (51; 71) in an axial direction and flows off towards the rotational axis (R) to the pressure port (P).

Aspect 15. The phase setter according to any one of the preceding aspects, wherein the feed (14, 15, 44; 64, 65, 66), the first connecting channel (16) and the second connecting channel (17) extend outside the control valve (20) through the rotor unit (100; 101).

Aspect 16. The phase setter according to any one of the preceding aspects, wherein the feed (14, 15, 44; 64, 65, 66) extends through the rotor unit (100; 101) from an inlet of the rotor unit (100; 101) to an outlet of the rotor unit (100; 101), the reflux valve device (50; 70) acts in a feed direction of the pressure fluid downstream of the inlet and upstream of the outlet, and the inlet emerges at an outer end-facing surface, and/or the outlet emerges at an inner circumference (11*a*; 60*a*), of the rotor unit (100; 101).

Aspect 17. The phase setter according to any one of the preceding aspects, wherein the feed (14, 15, 44; 64, 65, 66) is deflected towards the rotational axis (R) by means of the valve structure (51; 71), preferably at the valve structure (51; 71), such that the pressure fluid flows off from the valve structure (51; 71) towards the rotational axis (R).

Aspect 18. The phase setter according to any one of the preceding aspects, comprising a holding device (40; 60) which extends around the rotational axis (R) and holds the valve structure (51; 71) on an inner end-facing support surface (18; 63) of the rotor unit (100; 101) and which is preferably a constituent of the rotor unit (100; 101).

Aspect 19. The phase setter according to the preceding aspect, wherein the feed (14, 15, 44; 64, 65, 66) is deflected towards the rotational axis (R) by means of the valve structure (51; 71) and/or holding device (40; 60), preferably at the valve structure (51; 71) and/or holding device (40; 60), such that the pressure fluid flows off from the valve structure (51; 71) and/or holding device (40; 60) towards the rotational axis (R).

Aspect 20. The phase setter according to any one of the preceding aspects, wherein the rotor unit (100; 101) comprises an insert (40; 60) which is arranged in an accommodating space (13; 19) of the rotor (10), which extends around the rotational axis (R), and delineates the feed (14, 15, 44; 64, 65, 66) and/or at least one of the connecting channels (16, 17) and preferably forms the holding device (40; 60).

Aspect 21. The phase setter according to the preceding aspect, wherein the feed (14, 15, 44; 64, 65, 66) extends along the insert (40; 60) and/or through the insert (60).

Aspect 22. The phase setter according to any one of the immediately preceding two aspects, wherein the insert (40; 60) delineates at least one of the connecting channels (16, 17) and separates it/them from the feed (14, 15, 44; 64, 65, 66).

Aspect 23. The phase setter according to any one of the immediately preceding three aspects, wherein the first connecting channel (16) extends through the insert (40; 60) and/or along the insert (40).

Aspect 24. The phase setter according to any one of the immediately preceding four aspects, wherein the second connecting channel (17) extends through the insert (60) and/or along the insert.

Aspect 25. The phase setter according to any one of the immediately preceding five aspects, wherein the feed (14, 15, 44; 64, 65, 66) comprises a feed portion (15; 66) which extends from an inner circumference (11*a*; 60*a*) of the rotor unit (100; 101) into the accommodating space (13; 19).

Aspect 26. The phase setter according to any one of the immediately preceding six aspects, wherein the feed (14, 15, 64; 64, 65, 66) comprises an upstream feed portion (14; 64) and, adjoining it in a feed direction, a deflecting portion (44; 65) delineated by the rotor (10) and at least one of the insert (40; 60) and the valve structure (51; 71), and the insert (40) and/or the rotor (10) and/or the valve structure (51; 71) form(s) a wall (45, 52; 19', 71) of the deflecting portion (44; 65), axially opposite the upstream feed portion (14; 64) for deflecting the pressure fluid.

Aspect 27. The phase setter according to the preceding aspect, wherein the deflecting portion (44; 65) extends around the rotational axis (R).

Aspect 28. The phase setter according to the preceding aspect, wherein the deflecting portion (44; 65) extends circumferentially and self-contained around the rotational axis (R).

Aspect 29. The phase setter according to any one of the preceding aspects in combination with Aspect 20, wherein the feed (14, 15, 44; 64, 65, 66) extends such that the pressure fluid flows off downstream of the valve structure (51; 71) from the insert (40; 60) towards the rotational axis (R) to the pressure port (P).

Aspect 30. The phase setter according to any one of the preceding aspects in combination with Aspect 20, wherein the first connecting channel (16) and the second connecting channel (17) extend at an axial distance from each other from an inner circumference of the rotor unit (100; 101) to an outer circumference (11*c*) of the rotor unit (100; 101), and at least one of the connecting channels (16, 17) leads through the insert (40; 60).

Aspect 31. The phase setter according to any one of the preceding aspects in combination with Aspect 20, wherein at least one of the connecting channels (16, 17) comprises a connecting portion (16.1) which extends from an inner circumference (11*a*) of the rotor unit (100) into the accommodating space (13).

Aspect 32. The phase setter according to any one of the preceding aspects in combination with Aspect 20, wherein the feed (14, 15, 44) and at least one of the connecting channels (16, 17) emerge in the accommodating space (13), and the insert (40) separates the feed (14, 15, 44) in the accommodating space (13) from said at least one of the connecting channels (16, 17).

Aspect 33. The phase setter according to any one of the preceding aspects in combination with Aspect 20, wherein the feed (64, 65, 66) comprises an upstream feed portion (64), which extends through the insert (60), and/or a downstream feed portion (66) which extends from an inner circumference (60*a*) of the insert (60) radially outwards through the insert (60).

Aspect 34. The phase setter according to any one of the preceding aspects, wherein the rotor (10) is a sintered body or cast body, preferably made of metal.

Aspect 35. The phase setter according to any one of the preceding aspects, wherein the rotor (10) is a composite body consisting of a matrix material, made of metal or plastic, and one or more reinforcing bodies embedded in the matrix material and/or one or more particles embedded in the matrix material.

Aspect 36. The phase setter according to any one of the preceding aspects in combination with any one of Aspects 18 and 20, wherein the insert (40; 60) and/or holding device (40; 60) is formed from plastic, preferably by injection moulding, or by pressing and sintering, preferably pressing and sintering a metal powder, or as an aluminium or zinc die-cast body.

Aspect 37. The phase setter according to any one of the preceding aspects, wherein the valve structure (71) is an annular disc made of metal or plastic, for example fibre-reinforced epoxy resin.

Aspect 38. The phase setter according to any one of the preceding aspects, wherein the valve structure (51) is a metallic annular lamella comprising one or more spring tongues (52) which are isolated by etching, punching or laser-cutting.

Aspect 39. The phase setter according to any one of the preceding aspects in combination with Aspect 20, wherein:

the rotor (10) comprises a rotor hub (11), featuring an inner circumference (11*a*) which extends around the rotational axis (R) and an outer circumference (11*c*) which extends around the inner circumference (11*a*), and one or more rotor vanes (12), and the respective rotor vane (12) protrudes radially outwards from the outer circumference (11*c*) of the rotor hub (11);

the rotor hub (11) comprises the accommodating space (13) which extends radially around the rotational axis (R) between the inner circumference (11*a*) and the outer circumference (11*c*);

a linear bore (15, 15*b*) traverses the rotor hub (11), from the outer circumference (11*c*) towards the inner circumference (11*a*), in the region of the accommodating space (13);

the bore (15, 15*b*) comprises an outer bore portion (15*b*), which extends from the outer circumference (11*c*) up to the accommodating space (13), and an inner bore portion which extends from the inner circumference (11*a*) up to the accommodating space (13) and forms a feed portion (15) of the feed (14, 15, 44); and the insert (40) seals the outer bore portion (15*b*) and thus separates it from the feed portion (15) of the feed (14, 15, 44).

Aspect 40. The phase setter according to any one of Aspects 1 to 38 in combination with Aspect 20, wherein:

the rotor (10) comprises a rotor hub (11), featuring a central axial passage and an outer circumference (11*c*) which extends around the passage, and one or more rotor vanes (12), and the respective rotor vane (12) protrudes radially outwards from the outer circumference (11*c*) of the rotor hub (11);

the passage comprises a narrow axial portion and a wide axial portion and widens in steps from the narrow axial portion into the wide axial portion, such that an inner end-facing surface (19') of the rotor (10) is obtained in the passage; and the wide axial portion forms the accommodating space (19) in which the insert (60) is arranged, wherein the insert (60) preferably forms an inner circumference (60*a*) of the rotor unit (10, 60).

Aspect 41. The phase setter according to the preceding aspect, wherein:

the insert (60) comprises a first axial portion (61) and a second axial portion (62) and widens in steps from the second axial portion (62) to the first axial portion (61);

the second axial portion (62) forms a facing end of the insert (60) and/or holding device (60), wherein said facing end axially faces the inner end-facing surface (19') of the rotor; and the inner end-facing surface (19') of the rotor, the first axial portion (61) of the insert (60), an inner circumference (11*b*) of the rotor (10) and an outer circumference of the second axial portion (62) of the insert (60) delineate a deflecting portion (65) of the feed (64, 65, 66) which extends around the rotational axis (R).

Aspect 42. The phase setter according to the preceding aspect, wherein the facing end of the insert (60) is in a contact—which is sealed around the rotational axis (R)—with the inner end-facing surface (19') of the rotor.

Aspect 43. The phase setter according to any one of the preceding aspects in combination with Aspect 20, wherein the rotor (10) comprises an accommodating space (13; 19) which extends around the rotational axis (R) and axially from an inner end-facing surface (18; 19') of the rotor (10) up to an facing end of the rotor (10), and the insert (40; 60) is inserted axially into the accommodating space (13; 19) via the facing end, wherein in a preferred embodiment, said inner end-facing surface (18) of the rotor (10) forms the inner end-facing support surface (18).

Aspect 44. The phase setter according to any one of the preceding aspects in combination with Aspect 18, wherein the holding device (60) comprises one or more engaging structures (49) for positioning the valve structure (51) with respect to a circumferential direction and preferably for holding the valve structure (51) on the holding device (40).

Aspect 45. The phase setter according to any one of the preceding aspects in combination with any one of Aspects 18 and 20, wherein at least one end-facing side of the insert (40) or holding device (40) comprises one or more elastically or plastically deformable equalising structures (47) for equalising axial production tolerances and fitting tolerances, and/or a circumference of the insert (40) or holding device (40) comprises one or more elastically or plastically deformable equalising structures for equalising radial production tolerances and fitting tolerances.

Aspect 46. The phase setter according to any one of the preceding aspects, wherein the reflux valve device (50) is embodied as a Reed valve device.

Aspect 47. The phase setter according to any one of the preceding aspects, wherein the feed (14, 15, 44) comprises multiple feed channels (14*a*, 14*b*) in a distribution in a circumferential direction, and the valve structure (51) comprises multiple spring tongues (52), which are elastically flexible in an axial direction, in a distribution in a circumferential direction, wherein the respective spring tongue (52) preferably protrudes in a circumferential direction and is preferably elongated in a circumferential direction.

Aspect 48. The phase setter according to the preceding aspect, wherein exactly one of the spring tongues (52) is provided for each of the feed channels (14*a*, 14*b*).

Aspect 49. The phase setter according to any one of the preceding aspects, wherein the valve structure (51) comprises one or more spring tongues (52), and the respective spring tongue (52) extends in a circumferential direction.

Aspect 50. The phase setter according to the preceding aspect, wherein the respective spring tongue (52) extends up to an outer circumference of the valve structure (51).

Aspect 51. The phase setter according to any one of the preceding aspects, wherein the valve structure (51) comprises a ring (52*a*), which extends around the rotational axis (R), and one or more spring tongues (52), and the respective spring tongue (52) freely protrudes radially outwards from the ring (52*a*) in a base region and extends freely from its base region in a circumferential direction.

Aspect 52. The phase setter according to the preceding aspect, wherein a slot-shaped clearance (53), which follows an outer contour of the ring (52*a*), isolates the respective spring tongue (52) from the ring (52*a*), such that it can elastically bend in an axial direction.

Aspect 53. The phase setter according to any one of the preceding aspects, wherein the valve structure (51) comprises one or more spring tongues (52), and the rotor unit (100)—preferably the insert (40) of Aspect 20 or the holding device (40) of Aspect 18—comprises an assigned contact surface (45) for the respective spring tongue (52), axially opposite the respective spring tongue (52).

Aspect 54. The phase setter according to the preceding aspect, wherein the feed (14, 15, 44) comprises an upstream feed portion (14) which the respective contact surface (45) axially faces across the valve structure (51), and the pressure fluid flowing through the reflux valve device (50) is deflected towards the rotational axis (R) at the respective spring tongue (52) and/or the assigned contact surface (45).

Aspect 55. The phase setter according to any one of the immediately preceding two aspects, wherein the rotor unit (100)—preferably the holding device (40) of Aspect 18 or the insert (40) of Aspect 20—comprises an assigned axial recess (43) for the respective spring tongue (52), wherein the respective spring tongue (52) can axially yield into said axial recess (43) up to and against the assigned contact surface (45), and the respective recess (43) comprises an outlet towards the rotational axis (R) which preferably extends over the entire inner circumference of the respective recess (43), such that the pressure fluid flowing through the reflux valve device (50) is deflected towards the rotational axis (R) at the respective spring tongue (52) and/or the assigned contact surface (45).

Aspect 56. The phase setter according to any one of the immediately preceding three aspects, wherein the respective contact surface (45) exhibits an inclination in relation to the axial direction, preferably a constant inclination, such that an axial distance between a cross-sectional plane, in which the valve structure (51) extends, and the respective contact surface (45) changes.

Aspect 57. The phase setter according to any one of the immediately preceding four aspects, wherein the respective contact surface (45) extends continuously in a circumferential direction up to an end-facing surface (41*s*) of the rotor unit (100).

Aspect 58. The phase setter according to any one of the immediately preceding five aspects, wherein the feed (14, 15, 44) comprises an upstream feed portion (14) which the contact surface (45) axially faces across the valve structure (51), and the upstream feed portion (14) is adjoined by a deflecting portion (44), which is delineated by the contact surface (45), for deflecting the pressure fluid towards the rotational axis (R).

Aspect 59. The phase setter according to any one of Aspects 1 to 46, wherein the valve structure (71) as a whole can be axially moved back and forth between a minimum flow position, which can be a blocking position for preventing backflow, and a maximum flow position, and the reflux valve device (70) comprises one or more springs (73) for generating a spring force which charges the valve structure (71) towards the minimum flow position.

Aspect 60. The phase setter according to the preceding aspect, wherein: the valve structure (51; 71) axially faces an inner end-facing support surface (63) of the rotor unit (101); the feed (64, 65, 66) comprises a feed portion (64) featuring one or more feed channels (64*a*, 64*b*) which extend in a distribution in a circumferential direction and which each emerge at the inner end-facing support surface (63); and in the minimum flow position, the valve structure (71) is pressed by the spring force against the inner end-facing support surface (63) and thereby against where the respective feed channel (64*a*, 64*b*) emerges.

Aspect 61. The phase setter according to the preceding aspect, wherein the inner end-facing support surface (63) is an end-facing surface of the holding device (60) of Aspect 18 or an end-facing surface of the insert (60) of Aspect 20.

Aspect 62. The phase setter according to any one of the immediately preceding three aspects, wherein the respective spring (73) is supported on the holding device (60) of Aspect 18 or on the insert (60) of Aspect 20.

Aspect 63. The phase setter according to any one of the immediately preceding four aspects, wherein: the reflux valve device (70) comprises one or more guiding elements (74) which preferably each protrude from the holding device (60) of Aspect 18 or from the insert (60) of Aspect 20; and the respective guiding element (74) axially guides the valve structure (71) and forms a counter bearing (75) for the respective spring (73).

Aspect 64. The phase setter according to any one of the immediately preceding five aspects, wherein the feed (64, 65, 66) comprises an upstream feed portion (64) which an inner end-facing surface (19') of the rotor (10) axially faces across the valve structure (71), and the upstream feed portion (64) is adjoined by a preferably annular deflecting portion (65), which is delineated by the inner end-facing surface (19') of the rotor (10), for deflecting the pressure fluid towards the rotational axis (R).

Aspect 65. The phase setter according to any one of the preceding aspects, wherein the reflux valve device (50; 70) exhibits an eigenfrequency with respect to its ability to move axially which is above the actuating frequency of the valves controlled by the cam shaft (N).

Aspect 66. The phase setter according to any one of the preceding aspects, comprising a dirt filter (55; 80) which is arranged in the feed (14, 15, 44; 64, 65, 66) and extends around the rotational axis (R).

Aspect 67. The phase setter according to the preceding aspect, wherein the dirt filter (55; 80) is arranged in or on the rotor unit (100; 101).

Aspect 68. The phase setter according to any one of the immediately preceding two aspects, wherein the dirt filter (55; 80) is arranged between the reflux valve device (50; 70) and the pressure port (P) in an inflow direction of the pressure fluid.

Aspect 69. The phase setter according to any one of the immediately preceding three aspects, wherein the feed (14, 15, 44; 64, 65, 66) extends through the dirt filter (55; 80) from the radially outer side towards the rotational axis (R).

Aspect 70. The phase setter according to any one of the immediately preceding four aspects, wherein the feed (14, 15, 44; 64, 65, 66) feeds the pressure fluid to the dirt filter (55; 80) such that it exhibits a tangential directional component with respect to the rotational axis (R).

Aspect 71. The phase setter according to any one of the immediately preceding five aspects, wherein a collecting space (44*b*; 65) for dirt particles held back by the dirt filter (55; 80) extends in the feed (14, 15, 44; 64, 65, 66) around the dirt filter (55; 80).

Aspect 72. The phase setter according to any one of the immediately preceding six aspects in combination with any one of Aspects 18 and 20, wherein the insert (40) or holding device (40) surrounds the dirt filter (55), or the dirt filter (80) surrounds an outer circumference of the insert (60) or holding device (60), and a collecting space (44*b*; 65) for dirt particles remains circumferentially around the rotational axis (R), immediately around the dirt filter (55; 80) radially, between the dirt filter (55; 80) and the insert (40; 60) or holding device (40; 60).

Aspect 73. The phase setter according to any one of the preceding aspects, comprising a dirt filter (55; 80) which is held or at least axially secured in the feed (14, 15, 44; 64, 65, 66) by means of the holding device (40; 60) of Aspect 18 or by the insert (40; 60) of Aspect 20 and which preferably extends around the rotational axis (R).

Aspect 74. The phase setter according to the preceding aspect, wherein the dirt filter (55; 80) is arranged on the holding device (40; 60) or insert (40; 60).

Aspect 75. The phase setter according to the preceding aspect, wherein the dirt filter (55; 80) is held on the holding device (40; 60) or insert (40; 60) and can be inserted into the rotor (10) together with the holding device (40; 60) or insert (40; 60) when the phase setter is assembled.

Aspect 76. The phase setter according to any one of the immediately preceding four aspects, wherein the holding device (40; 60) or insert (40; 60) comprises one or more filter engaging structures (48; 68) for positioning and/or holding the dirt filter (55; 80) on the holding device (40; 60) or insert (40; 60).

Aspect 77. A phase setter for adjusting the rotational angular position of a cam shaft relative to a crankshaft of an internal combustion engine, the phase setter comprising:

(a) a stator (1) for rotary-driving the phase setter using the crankshaft;

(b) a rotor (10) which can be rotated relative to the stator (1) about a rotational axis (R) and can be coupled to the cam shaft (N) in order to drive the cam shaft (N), and which together with the stator (1) forms a first pressure chamber ($K_1$) and a second pressure chamber ($K_2$) which can be charged with a pressure fluid in order to be able to adjust the rotor (10) relative to the stator (1) about the rotational axis (R);

(c) a control valve (20) featuring a pressure port (P), a first working port (A) and a second working port (B), respectively, for the pressure fluid;

(d) and a feed (14, 15, 44; 64, 65, 66) for the inflow of pressure fluid to the pressure port (P), a first connecting channel (16) for connecting the first pressure chamber ($K_1$) to the first working port (A), and a second connecting channel (17) for connecting the second pressure chamber ($K_2$) to the second working port (B).

Aspect 78. The phase setter according to the preceding aspect, comprising a reflux valve device (50; 70) which acts in the feed (14, 15, 44; 64, 65, 66) and comprises a valve structure (51; 71) which extends annularly around the rotational axis (R) and comprises one or more axially movable spring tongues (52) or can be axially moved in order to restrict a backflow of pressure fluid through the feed (14, 15, 44; 64, 65, 66) more significantly than the inflow of pressure fluid to the pressure port (P).

Aspect 79. The phase setter according to any one of the immediately preceding two aspects, comprising an insert (40; 60) which extends around the rotational axis (R) and which is a constituent of a rotor unit (100; 101) comprising the rotor (10) and the insert (40; 60).

Aspect 80. The phase setter according to the preceding aspect, wherein the insert (40; 60) is the holding device (40; 60) of Aspect 18 and/or delineates the feed (14, 15, 44; 64, 65, 66) and/or delineates the first connecting channel (16) and/or delineates the second connecting channel (17) and/or separates at least one of the connecting channels (16, 17) from the feed (14, 15, 44; 64, 65, 66) and/or wherein the feed (14, 15, 44; 64, 65, 66) is deflected towards the rotational axis (R) by means of the insert (40; 60).

Aspect 81. The phase setter according to any one of the immediately preceding four aspects and at least one of Aspects 2 to 76 and 82 to 105.

Aspect 82. The phase setter according to any one of the preceding aspects, comprising:

a pressure storage (90) comprising a storage space (91, 92) and a piston (93) which can be moved within the storage space (91, 92);

and a storage feed channel (95; 85) which connects a pressure volume (91) of the storage space (91, 92) to the feed (14, 15, 44), wherein the storage feed channel (95; 85) extends through or along the rotor unit (100; 101), preferably through or along the rotor (10).

Aspect 83. The phase setter according to the preceding aspect, wherein the storage feed channel (95) diverts from the feed (14, 15, 44) in the rotor unit (100; 101), preferably in the rotor (10) or in the holding device (40) of Aspect 18 or the insert (40) of Aspect 20.

Aspect 84. The phase setter according to any one of the immediately preceding two aspects, wherein the storage feed channel (95; 85) diverts from the feed (14, 15, 44) in the rotor (10) or in the insert (40) of Aspect 79.

Aspect 85. The phase setter according to Aspect 78 and any one of the immediately preceding three aspects, wherein the storage feed channel (95) diverts from the feed (14, 15, 44) upstream of the reflux valve device (50; 70).

Aspect 86. The phase setter according to Aspect 78 and any one of Aspects 82 to 84, wherein the storage feed channel (85) diverts from the feed (14, 15, 44) downstream of the reflux valve device (50).

Aspect 87. The phase setter according to any one of the immediately preceding two aspects, wherein the storage feed channel (95; 85) diverts from the feed (14, 15, 44) upstream of a dirt filter (55) arranged in the feed (14, 15, 44).

Aspect 88. The phase setter according to any one of the immediately preceding six aspects, wherein the storage space (91, 92) in the stator (1) extends around the rotational axis (R).

Aspect 89. The phase setter according to the preceding aspect, wherein the storage space (91, 92) is sealed on an end-facing side by means of a stator cover (6).

Aspect 90. The phase setter according to any one of the immediately preceding eight aspects, wherein: on an outer circumference (12*a*) which radially lies directly opposite an inner circumference (2*a*) of the stator (1), a rotor vane (12'; 12") comprises a pocket-shaped channel portion (97) which is elongated in a circumferential direction; a channel portion (96; 86) of the storage feed channel (95) which extends through the rotor vane (12'; 12") connects the pocket-shaped channel portion (97) to the feed (14, 15, 44); and a channel portion (98) of the storage feed channel (95) which extends in the stator (1) connects the pocket-shaped channel portion (97) to the pressure volume (91) of the storage space (91, 92).

Aspect 91. The phase setter according to any one of the immediately preceding nine aspects, comprising a storage relief channel (99), which extends through or along the rotor (10) or in or along a rotor unit (100; 101) comprising the rotor (10), for draining leakage fluid from a relief volume (92) of the storage space (91, 92).

Aspect 92. The phase setter according to any one of the preceding aspects, wherein:

the stator (1) comprises an inner circumference (2*a*), which extends around the rotor (10), and stator vanes (4) which protrude radially inwards from the inner circumference (2*a*) of the stator (1); and the rotor (10) comprises a rotor hub (11), featuring an outer circumference (11*c*) which extends around the rotational axis (R), and rotor vanes (12) which protrude radially outwards from the outer circumference (11*c*) of the rotor hub (11), in each case between stator vanes (4) which are adjacent in a circumferential direction, in order to form the pressure chambers ($K_1$, $K_2$).

Aspect 93. The phase setter according to any one of the preceding aspects, wherein the control valve (20) comprises a valve housing (21) and a valve piston (30), which can be axially moved back and forth in the valve housing (21) between a first piston position and a second piston position, and the valve housing (21) protrudes through a rotor unit (100; 101) comprising the rotor (10) and is configured to non-rotationally connect the rotor unit (100; 101) to the cam shaft (N).

Aspect 94. The phase setter according to the preceding aspect, wherein one axial end region of the valve housing (21) comprises a joining portion (22) for a joining connection, preferably a screw connection, to the cam shaft (N), and the other axial end region of the valve housing (21) comprises a collar (23) which, when the phase setter is fitted, presses against the end-facing side of the rotor unit (100; 101) which faces away from the cam shaft (N), in order to non-rotationally clamp the rotor unit (100; 101) on the cam shaft (N).

Aspect 95. The phase setter according to any one of the preceding aspects, wherein a closure cover (39) arranged on an end-facing side of the rotor unit (100) axially secures the holding device (40) of Aspect 18 or the insert (40) of Aspect 20 or 79 and/or seals one or more pressure fluid channels, for example one or more of the connecting channels (16), on the end-facing side.

Aspect 96. The phase setter according to the immediately preceding two aspects, wherein the collar (23) of the valve housing (21) presses the closure cover (39) axially against the holding device (40) and presses the holding device (40) axially against the valve structure (51).

Aspect 97. The phase setter according to any one of the preceding aspects, wherein the holding device (40) of Aspect 18 or the insert (40) of Aspect 20 or 79 is arranged in an accommodating space (13) of the rotor (10), the accommodating space (13) is open on an end-facing side of the rotor (10), and a closure cover (39) seals the accommodating space (13) on the end-facing side.

Aspect 98. The phase setter according to the preceding aspect, wherein the closure cover (39) is inserted into the accommodating space (13) and held clamped on an inner circumference (11*b*) of the accommodating space (13).

Aspect 99. The phase setter according to any one of the preceding aspects, wherein the pressure port (P), the first working port (A) and the second working port (B) are arranged, axially offset with respect to each other, on a circumference of the control valve (20).

Aspect 100. The phase setter according to any one of the preceding aspects, wherein the pressure port (P) is arranged axially between the first working port (A) and the second working port (B), preferably on a circumference of the control valve (20).

Aspect 101. The phase setter according to the preceding aspect, wherein the control valve (20) comprises a valve housing (21) and a valve piston (30), which can be axially moved back and forth in the valve housing (21) between a first piston position and a second piston position, and an outer circumference (11) of the valve piston (30) comprises a control groove (33) which is connected to the pressure port (P) and the first working port (A) but separated from the second working port (B) in the first piston position and connected to the pressure port (P) and the second working port (B) but separated from the first working port (A) in the second piston position.

Aspect 102. The phase setter according to the preceding aspect, wherein the control groove (33) overlaps axially with the pressure port (P) and the first working port (A) in the first piston position and overlaps axially with the pressure port (P) and the second working port (B) in the second piston position.

Aspect 103. The phase setter according to any one of the immediately preceding two aspects, wherein the valve piston (30) comprises a control edge (34) which axially delineates the control groove (33) on the left, and a control edge (34) which axially delineates the control groove (33) on the right, and no other control edge.

Aspect 104. The phase setter according to any one of the preceding aspects, wherein the rotor (10) and additionally the valve structure (51; 71) and/or the holding device (40; 60) according to Aspect 18 and/or the insert (40) of Aspect 20 or 79 and/or the dirt filter (55; 80) according to any one of Aspects 63 to 73 are constituents of a rotor unit (100; 101) which can be non-rotationally fitted on the cam shaft (N).

Aspect 105. The phase setter according to any one of the preceding aspects, wherein the first working port (A) is connected to the first pressure chamber ($K_1$) and can be connected to the pressure port (P) by means of the control valve (20), and the second working port (B) is connected to the second pressure chamber ($K_2$) and can be connected to the pressure port (P) by means of the control valve (20).

BRIEF DESCRIPTION OF THE DRAWINGS

Aspects of the invention will be described below on the basis of example embodiments. Features disclosed by the example embodiments, each individually and in any combination of features, advantageously develop the subject-matter of the claims, the subject-matter of the aspects and also the embodiments described at the beginning. Features disclosed only by the respective example embodiment can also be implemented in the other example embodiments, providing there is no obvious contradiction. There is shown:

DETAILED DESCRIPTION OF THE INVENTION

Figure 1:
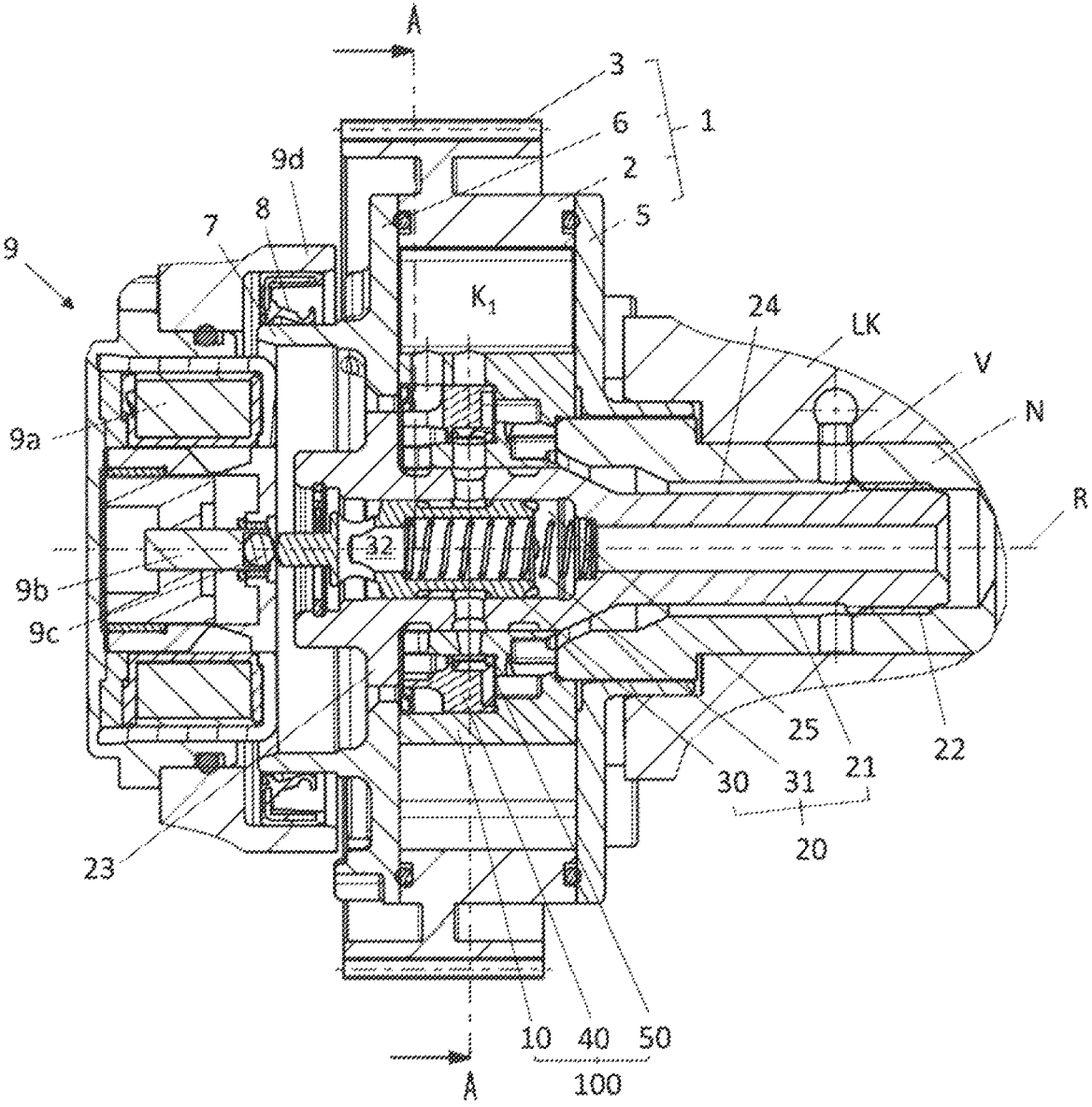
FIG. 1 a phase setter of a first example embodiment, fitted on a cam shaft, in a longitudinal section.

FIG. 1 shows a cam shaft phase setter of a first example embodiment, in a longitudinal section. The phase setter is fitted on an axial end of a cam shaft N of an internal combustion engine, for example a drive motor of a motor vehicle. The phase setter comprises a stator 1 which can be coupled to a crankshaft of the internal combustion engine for rotary-driving the phase setter about a central rotational axis R. The phase setter also comprises a rotor 10 which can be rotated about the rotational axis R and which is non-rotationally connected to the cam shaft N. A bearing body LK of the internal combustion engine, which mounts the cam shaft N such that it can rotate about the rotational axis R, is indicated in FIG. 1. The rotor 10 can be rotationally adjusted back and forth relative to the stator 1 by a particular rotational angle about the rotational axis R, in order to be able to adjust the phase position of the cam shaft N relative to the crankshaft, i.e. the rotational angular position of the cam shaft N relative to the crankshaft.

The stator 1 comprises a stator ring 2, a drive gear tooth system 3, a cover 5 on a side facing the cam shaft N, and a cover 6 on a side facing away from the cam shaft N. The stator ring 2 and the drive gear tooth system 3 are formed together in one piece in an original-moulding method. The covers 5 and 6 are non-rotationally joined to the stator ring 2. The stator ring 2 and its drive gear tooth system 3 together form a drive wheel for rotary-driving the phase setter and the cam shaft N which is driven via the phase setter. The drive gear tooth system 3 encircles the outer circumference of the stator ring 2. It can in particular be a drive gear tooth system for a belt drive.

Figure 3:
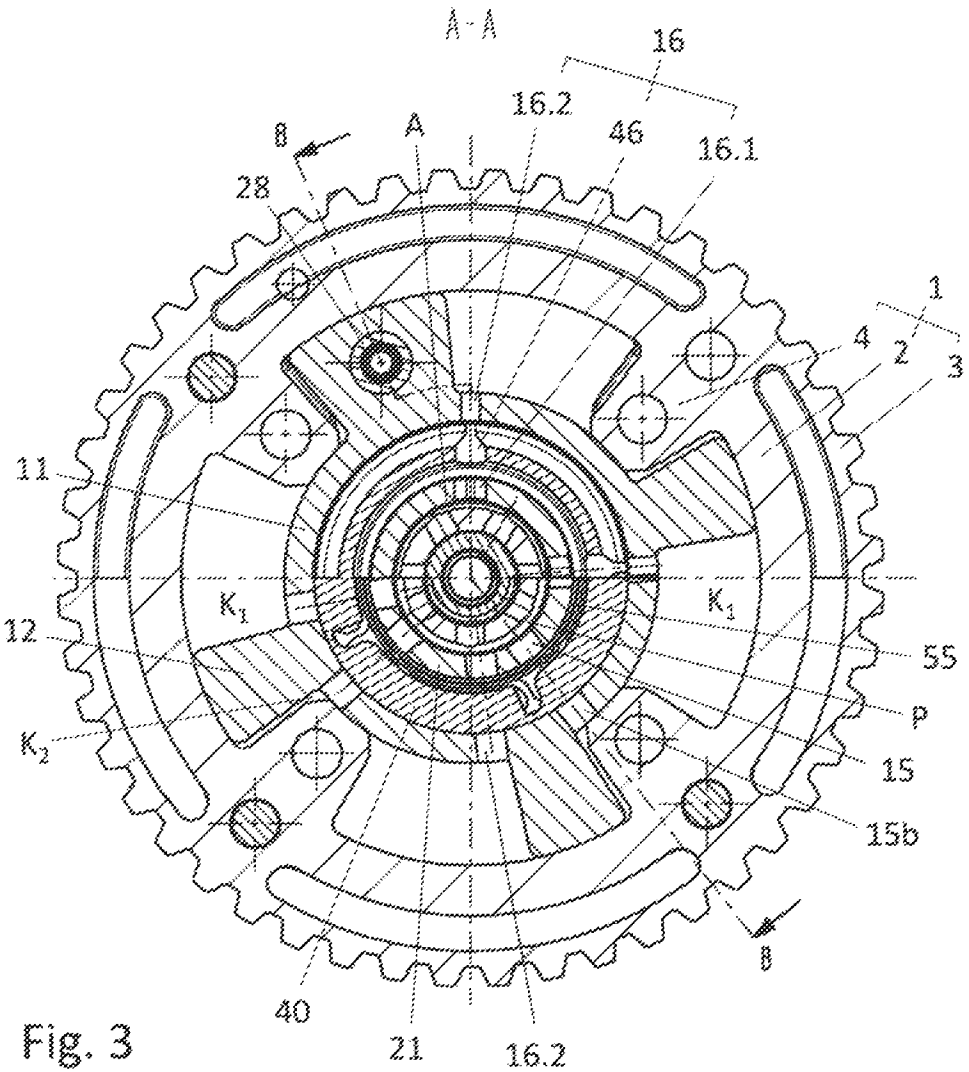
FIG. 3 the cross-section A-A in FIG. 1.

The stator 1 and the rotor 10 form multiple first pressure chambers $K_1$ and multiple second pressure chambers $K_2$ in a distribution around the rotational axis R, wherein the pressure chambers are shown in the cross-section in FIG. 3. The drive gear tooth system 3 overlaps axially with the pressure chambers $K_1$ and $K_2$. In modifications, the drive gear tooth system can be formed axially next to the pressure chambers $K_1$ and $K_2$. The overall length of the phase setter can be shortened by means of the axial overlap.

The phase setter comprises a control valve 20 for hydraulically controlling or regulating the phase position of the rotor 10 relative to the stator 1 and therefore that of the cam shaft N relative to the crankshaft. The control valve 20 comprises a valve housing 21 featuring a housing hollow space 25, a valve piston 30 which can be axially moved back and forth in the housing hollow space 25, and a valve spring 31 which is arranged in the housing hollow space 25. The valve spring 31 charges the valve piston 30 with a spring force in an axial direction in which it can be moved. The valve piston 30 is embodied as a hollow piston. The valve spring 31 protrudes axially into a hollow space 32 of the valve piston 30. One end of the valve spring 31 is supported on the valve piston 30, and the other end of the valve spring 31 is supported on the valve housing 21. The valve spring 31 is embodied as a helical pressure spring.

The phase position of the rotor 10 is hydraulically adjusted relative to the stator 1 by means of the control valve 20 within the context of controlling or regulating. The control valve 20 forms a setting member of a superordinate controller, for example an engine controller of a motor vehicle.

The phase setter is supplied with pressure fluid via supply channels V which extend through the cam shaft N into a hollow end portion of the cam shaft. The pressure fluid can, as for instance in the example embodiment, be guided to the supply channels V via the bearing body LK. If the phase setter is connected via the supply channels V to a lubricating oil system for lubricating the internal combustion engine, then the pressure fluid is lubricating oil which is diverted from the lubricating oil system, for the phase setter. The supply channels V emerge in the hollow end portion of the cam shaft N into an annular supplying portion 24 which is delineated on the radially outer side by the cam shaft N and on the inner side by the valve housing 21. The control valve 20 controls the inflow and outflow of the pressure fluid, supplied via the supplying portion 24, to and from the pressure chambers $K_1$ and $K_2$.

The control state or switched state of the control valve 20 is controlled or regulated by means of an electromagnetic device 9. The electromagnetic device 9 is connected to the superordinate controller or regulator, for example an engine controller of a motor vehicle, when the phase setter is fitted, and controls or regulates the control states and/or switched states of the control valve 20 in accordance with control signals of the controller or regulator. The control signals can in particular be current signals. The electromagnetic device 9 comprises an electric coil 9*a* and an anchor which can be axially moved back and forth and which comprises a plunger 9*b* which acts on the valve piston 30. The plunger 9*b* mounts a spherical body 9*c* which is in an axial abutting contact with the valve piston 30. The valve spring 31 presses the valve piston 30 axially into the abutting contact with the spherical body 9*c* of the plunger 9*b*. The electromagnetic device 9 acts counter to the valve spring 31.

The electromagnetic device 9 can be arranged stationarily. The rear side of the stator cover 6 which faces away from the cam shaft N and towards the electromagnetic device 9 comprises an annular appendage 7 which is surrounded by an annular appendage 9*d* on a housing of the electromagnetic device 9. A gasket 8 is arranged in an annular gap remaining between the annular appendages 7 and 9*d*, in order to seal off the space which exists between the electromagnetic device 9 and the rotating part of the phase setter.

The control valve 20 serves a second function of non-rotationally connecting the rotor 10 to the cam shaft N. Together with other components which will be described further below, the rotor 10 is a constituent of a rotor unit 100 which can be fitted on the cam shaft N by means of the control valve 20. In order to fit it, the valve housing 21 protrudes axially through the rotor 10, and a shaft portion of the valve housing 21 protrudes axially beyond the rotor 10 and into the hollow end portion of the cam shaft N. Within the hollow end portion of the cam shaft N, the valve housing 21 is joined to the cam shaft N in a joining portion 22, wherein the supplying portion 24 remains free. The joining portion 22 can in particular be a screwing portion. The valve housing 21 likewise protrudes axially beyond the rotor 10 in the other axial direction and comprises, in that end region, a radial widening in the form of a collar 23. The valve housing 21 serves as a central joining element, for example a screwing element. When joined and/or fitted, the rotor 10 is axially clamped between the cam shaft N and the collar by to the cam shaft N and thus non-rotationally connected to the cam shaft N. Control valves like the control valve 20 are also referred to as central valves because they are arranged centrally in the phase setter.

Figure 2:
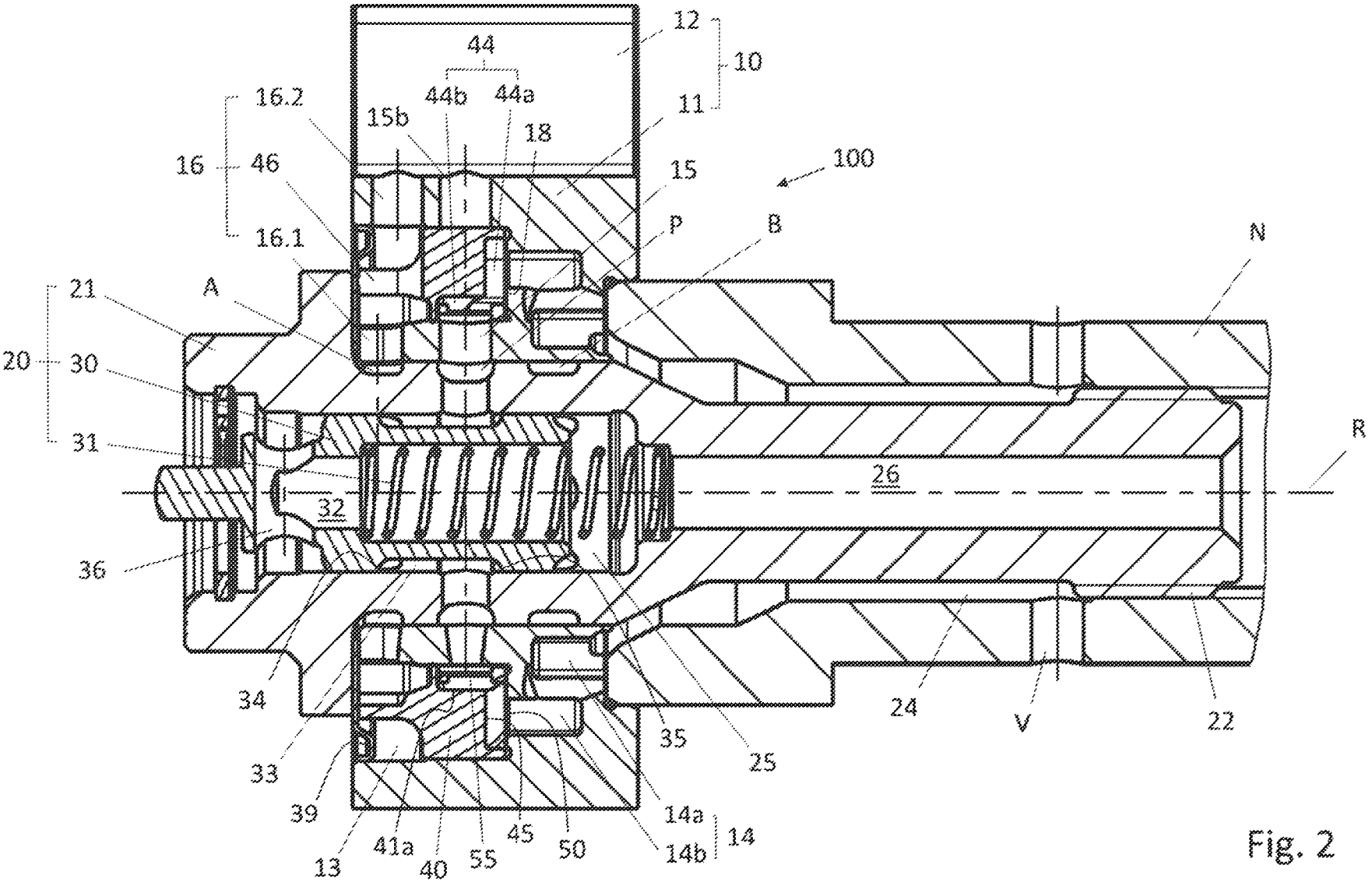
FIG. 2 components of a rotor unit of the phase setter of the first example embodiment, which are non-rotationally connected to the cam shaft, in the longitudinal section in FIG. 1.

FIG. 2 shows only the control valve 20, and the rotor unit 100 which is non-rotationally connected by the control valve 20 to the cam shaft N, of the phase setter of the first example embodiment. For simplicity, the stator 1 and the electromagnetic device 9 and the bearing body LK are not shown.

The phase setter is connected to the external pressure fluid supply system via the cam shaft N and the annular supplying portion 24 which remains between the cam shaft N and the valve housing 21. An outer circumference of the control valve 20 comprises a pressure port P in axial overlap with the rotor 10, a first working port A axially next to the pressure port P on one side, and a second working port B axially next to the pressure port P on the other side. The ports P, A and B are each embodied as a circumferential connecting groove on the outer circumference of the valve housing 21. They are connected to the central housing hollow space 25 via valve channels which extend radially in the valve housing 21.

The outer circumference of the valve piston 30 comprises a control groove 33 which advantageously encircles the entire circumference. The pressure port P is connected to the control groove 33 in every axial position of the valve piston 30. The control groove 33 is axially delineated on both sides by control edges 34 and 35. Each of the control edges 34 and 35 is axially adjoined by a piston stay. The valve piston 30 is guided in the housing hollow space 25 such that it can slide within the axial region of these two piston stays, wherein the piston stays seal off the control groove 33 on both sides. Arranging the pressure port P axially between the working ports A and B favours the use of the valve piston 30 which, with only one control groove 33, is comparatively simple and axially short.

In a co-operation between the electromagnetic device 9 (FIG. 1) and the valve spring 31, the valve piston 30 can be axially moved back and forth between a first piston position and a second piston position. In the first piston position, which the valve piston 30 has assumed in FIG. 2, the control groove 33 overlaps with the valve channels for the working port A, while one piston stay separates the valve channels of the working port B from the control groove 33, such that the pressure port P is connected to the working port A via the control groove 33 and is separated from the working port B. If the valve piston 30 is moved into the second piston position by means of the electromagnetic device 9, counter to the spring force of the valve spring 31, the control groove 33 passes out of the axial overlap with the working port A and its assigned valve channels and into an overlap with the working port B and its valve channels. In the second piston position, the pressure port P is thus connected to the working port B via the control groove 33 and is separated from the working port A.

Figure 4:
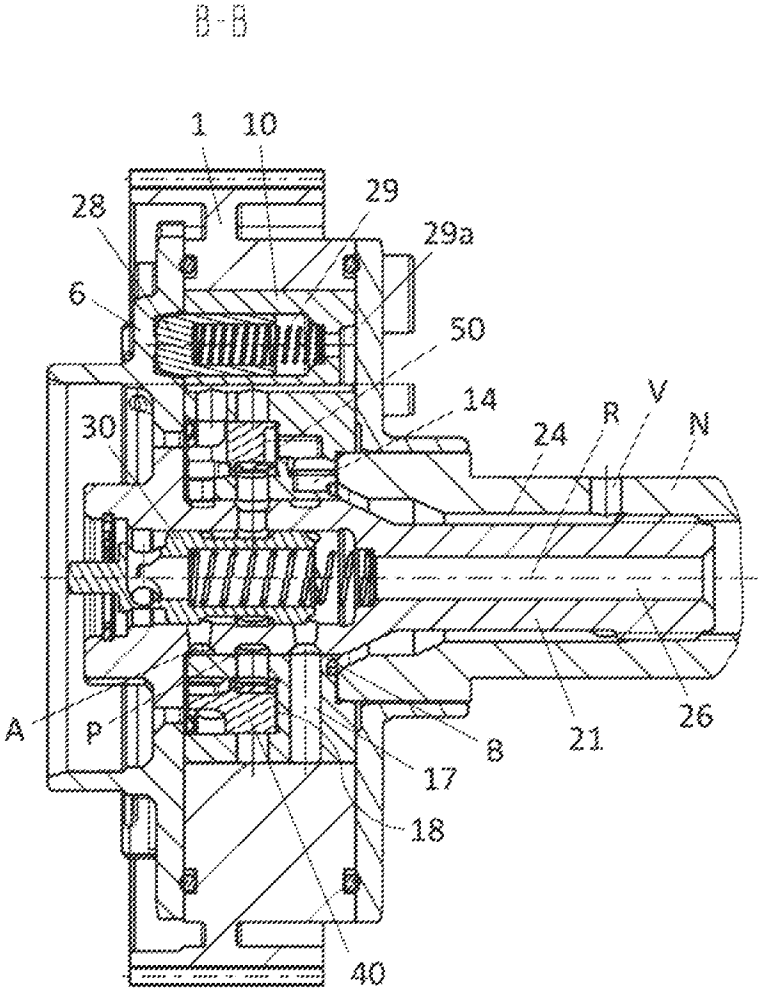
FIG. 4 the longitudinal section B-B in FIG. 3.

If the valve piston 30 assumes the first piston position, as shown in FIGS. 1, 2 and 4, the working port B is short-circuited with the housing hollow space 25, thus bypassing the valve piston 30, such that pressure fluid can flow from the second pressure chambers $K_2$ via the working port B into the housing hollow space 25, whence it can flow off through an adjoining axial outflow portion 26 of the valve housing 21 towards a pressure fluid reservoir of the supply system, and the pressure chambers $K_2$ are relieved of pressure. If the valve piston 30 assumes the second piston position, the working port A is connected to the outflow portion 26 via the valve piston 30. For draining fluid from the working port A, the valve piston 30 comprises an aperture 36 which connects the housing hollow space 25 to the piston hollow space 32. The pressure fluid can thus flow off from the working port A into the housing hollow space 25, then through the aperture 36 into the piston hollow space 32 and from there through the outflow portion 26. The two groups of pressure chambers $K_1$ and $K_2$ are thus respectively relieved of pressure via the central housing hollow space 25 and the outflow portion 26, wherein the pressure chambers $K_2$ are relieved directly and the pressure chambers $K_1$ are relieved via the piston hollow space 32.

Starting from the housing hollow space 25, the outflow portion 26 extends through the shaft portion of the valve housing 21 which protrudes into the cam shaft N. The outflow portion 26 extends coaxially with the supplying portion 24, wherein the supplying portion 24 surrounds the outflow portion 26.

The pressure port P is connected to the supplying portion 24 via a feed which leads through the rotor 10. The feed is composed of multiple feed portions 14, 44 and 15 which are consecutive in a flow direction, wherein the downstream end of the annular supplying portion 24 emerges into the upstream feed portion 14 which is formed in the rotor 10 and adjoined in an inflow direction by the feed portion 44. In the feed portion 44, the pressure fluid flowing to the pressure port P is deflected inwards, towards the rotational axis R. Due to this function, the feed portion 44 is referred to hereinafter as the deflecting portion 44. The deflecting portion 44 is adjoined by the downstream feed portion 15 which emerges into the pressure port P.

The working port A is connected to the pressure chambers $K_1$ via first connecting channels 16 which extend from the inner circumference 11*a* (FIGS. 5 and 6) to the outer circumference 11*c* of the rotor hub 11. The working port B is connected to the pressure chambers $K_2$ via second connecting channels 17 which likewise extend from the inner circumference 11*a* to the outer circumference 11*c* of the rotor hub 11. One of the connecting channels 16, which connects the working port A to one of the pressure chambers $K_1$, is shown in FIG. 2. One of the connecting channels 17, which connects the working port B to one of the assigned pressure chambers $K_2$, is shown in the longitudinal section in FIG. 4.

In order to separate it from the connecting channels 17 (FIG. 4) which extend in axial overlap with it, the feed portion 14 (FIG. 2) which extends in the rotor 10 is sub-divided into multiple feed channels which are spaced from each other in a circumferential direction around the rotational axis R and which extend in a circumferential direction between respectively adjacent connecting channels 17.

The annular supplying portion 24 extends in an axially straight line from the supply channels V towards the rotor 10 up to a connecting region and extends at an inclination radial outwards in the connecting region up to the feed portion 14. The supplying portion 24 thus widens radially in the connecting region in an axial direction towards the feed portion 14. The feed channels of the feed portion 14 each comprise an upstream channel portion 14*a*, which is immediately adjoined by the connecting region of the supplying portion 24, and a downstream channel portion 14*b* which overlaps on the radially outer side with the upstream channel portion 14*a*. The feed portion 14 therefore has a stepped profile as viewed in a longitudinal section. In the example embodiment, each of the assembled feed channels 14*a*, 14*b* extends outwards in steps from the supplying portion 24 into the deflecting portion 44.

A reflux valve device 50, which is arranged in the region where the feed portion 14 transitions into the deflecting portion 44, allows an inflow to the pressure port P with little resistance but prevents or at least significantly restricts a backflow. The reflux valve device 50 is shaped as an annular disc and extends axially around the rotational axis R between a cross-sectional plane which intersects the pressure port P and a cross-sectional plane which intersects the working port B. It axially exhibits a distance from the connecting channels 17 (FIG. 4) adjoining the working port B and, when fluid is not flowing through it, also from the downstream feed portion 15. Thus, when fluid is not flowing through it, it axially overlaps with neither the feed portion 15 nor the connecting channels 17. Since the feed portion 14 extends outwards in steps, but then extends in the axial direction in its downstream axial portion 14*b* up to the reflux valve device 50, the pressure fluid in the feed portion 14 is initially guided radially outwards but then guided at least substantially in an axial direction against the reflux valve device 50.

The reflux valve device 50 is held clamped in position by means of a holding device 40. The holding device 40 is arranged in an annular accommodating space 13 of the rotor 10. It extends annularly around the rotational axis R and presses the reflux valve device 50 against an inner end-facing surface 18 of the rotor 10 in a seal circumferentially around the rotational axis R, uniformly throughout.

The accommodating space 13 is open on an end-facing side of the rotor 10, such that the reflux valve device 50 and the holding device 40 can be axially inserted into the open accommodating space 13. In the example embodiment, the rotor 10 is open on its rear side which faces away from the cam shaft N. In modifications, however, the accommodating space 13 can instead also be closed on its rear side and open on the front side of the rotor 10 which faces the cam shaft N. An accommodating space 13 which is open towards the rear side does however make it easier to embody the rotor 10 such that the rotor 10 is directly pressed against the end-facing side of the cam shaft N by means of the valve housing 21.

A closure cover 39 seals the accommodating space 13 on the end-facing side which is open towards the rear. When fitted, the collar 23 of the valve housing 21 presses the closure cover 39 axially against the rear side of the rotor 10 and also against the rear side of the holding device 40, such that the holding device 40 is pressed against the reflux valve device 50 and the reflux valve spring presses against the inner end-facing surface 18 of the rotor 10. The closure cover 39 can for example be a sheet-metal cover.

In modifications, the holding device 40 can seal the accommodating space 13 on the rear side, such that the closure cover 39 can be omitted. In such embodiments, the collar 23 of the valve housing 21 would however be directly in contact with the holding device 40. If, as is preferred, the valve housing 21 serves as a fastening screw, there would be a danger in such embodiments of whittling on the rear side of the holding device 40 when screwing-in the valve housing 21.

Figure 5:
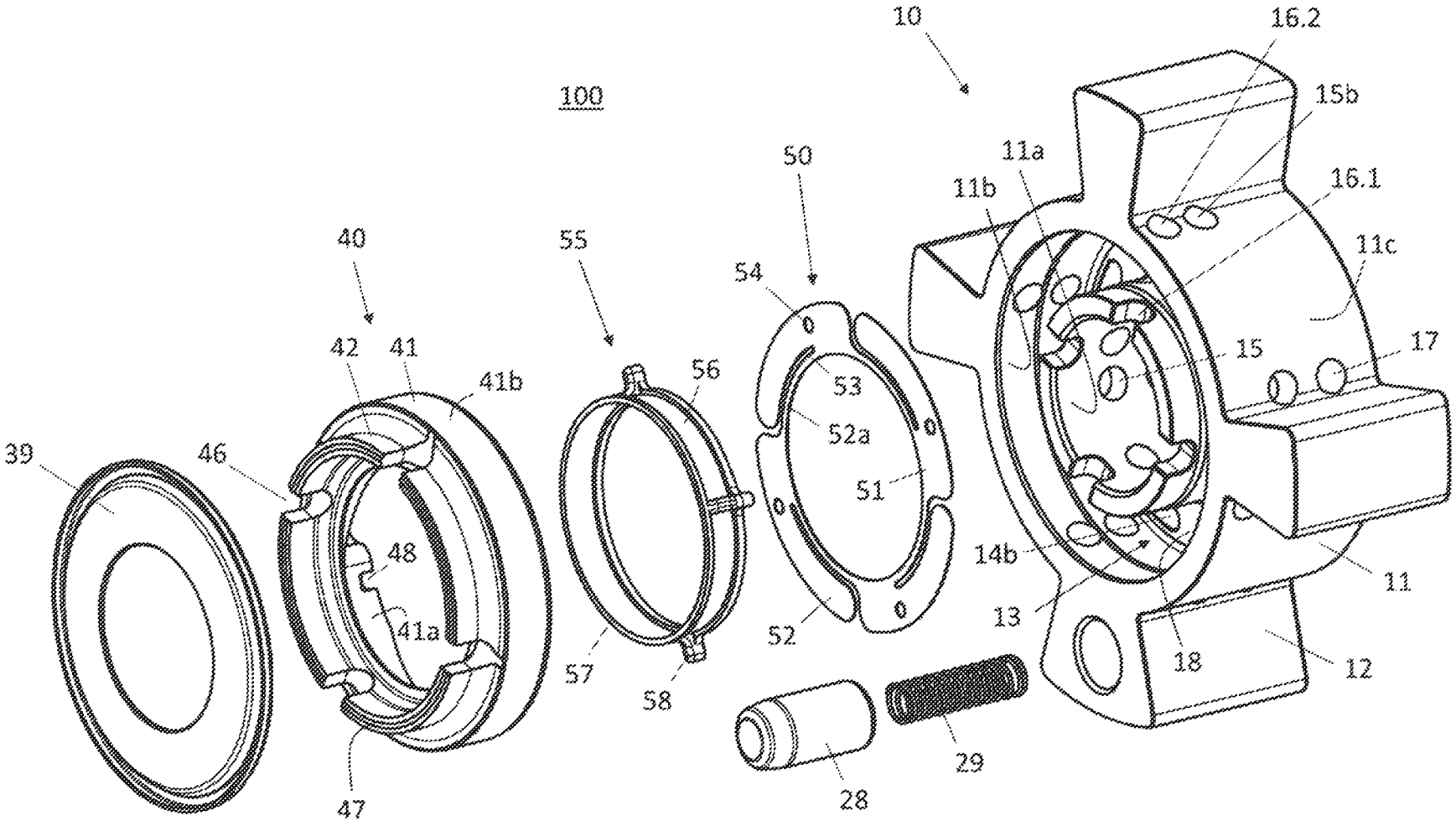
FIG. 5 components of the rotor unit of the first example embodiment, in an isometric representation.

The connecting channels 16 are each composed of multiple portions which are consecutive in a radial direction, as shown in particular in FIG. 2 by the example of one of the connecting channels 16 and in the isometric representation in FIG. 5. The connecting channels 16 each comprise an inner connecting portion 16.1 which extends outwards from the working port A into the accommodating space 13. An outer connecting portion 16.2 extends from the accommodating space 13 up to the outer circumference 11*c* of the rotor hub 11 and into the respectively assigned pressure chamber $K_1$. Since the holding device 40 is annular and extends in the accommodating space 13 up to and against the closure cover 39 due to being pressed onto it, the holding device 40 comprises multiple connecting portions 46, each in the form of a passage, in a distribution in a circumferential direction, in order to enable the inflow and outflow of pressure fluid to and from the pressure chambers $K_1$ through the accommodating space 13. The connecting portions 46 can, as in the example embodiment, overlap axially and in a circumferential direction with the connecting portions 16.1 and 16.2, in order to connect the working port A to the pressure chambers $K_1$ via a short route.

The connecting portions 46 of the holding device 40 on the one hand allow the flow of pressure fluid between the working port A and the pressure chambers $K_1$, but conversely separate the connecting channels 16 from the pressure fluid feed 14, 15, 44 by providing a seal between the connecting channels 16 and the feed 14, 15, 44 in the accommodating space 13. The holding device 40 thus not only performs the function of holding the reflux valve device 50 but also delineates a part of the respective connecting channel 16 and thus separates the connecting channels 16 from the feed 14, 15, 44.

The holding device 40 delineates the deflecting portion 44. It particularly advantageously serves to deflect the inflowing pressure fluid, i.e. the holding device 40 performs a function of deflecting the pressure fluid which flows to the pressure port P, by deflecting the pressure fluid which is inflowing in the feed portion 14 radially inwards from its inflow direction towards the rotational axis R. As it flows through the deflecting region 44, the pressure fluid flows along the holding device 40, wherein it is deflected. The holding device 40 delineates the deflecting portion 44 in an axial direction and on the radially outer side. The deflecting portion 44 which is delineated by the holding device 40 and the rotor 10 comprises: an inflow region 44*a* which, when fluid is not flowing through it, adjoins the feed portion 14 across the reflux valve device 50; and an outflow region 44*b* which extends around the rotational axis R in an inflow direction downstream of the inflow region 44*a* and is delineated on the radially outer side by an inner circumference 41*a* of the holding device 40. The outflow region 44*b* directly adjoins the inflow region 44*a*.

The holding device 40 also serves to hold a dirt filter 55. The dirt filter 55 extends around the rotational axis R. The inner circumference 41*a* of the holding device 40 surrounds the dirt filter 55 at a radial distance, thus providing a collecting space for dirt particles around the dirt filter 55 in the outflow region 44*b*.

FIG. 3 shows the cross-section A-A in FIG. 1. As marked in FIG. 1, the section A-A extends in an upper sectional plane and a lower sectional plane which each extend as far as the rotational axis R and which are axially offset with respect to each other along the rotational axis R.

The phase setter is embodied to have a vane-cell design. Multiple stator vanes 4 protrude inwards from the stator ring 2 towards the rotational axis R in a distribution over the circumference. The rotor 10 comprises a rotor hub 11 and multiple rotor vanes 12 which protrude radially outwards in a distribution over the circumference of the rotor hub 11. Each of the rotor vanes 12 protrudes outwards between two stator vanes 4 which are adjacent in a circumferential direction. The rotor vanes 12 divide each of the spaces delineated radially by the stator ring 2 and rotor hub 11 and in a circumferential direction by adjacent stator vanes 4 into one of the first pressure chambers $K_1$ and one of the second pressure chamber $K_2$. By charging the first pressure chambers $K_1$ with pressure, while simultaneously relieving the second pressure chamber $K_2$ of pressure, it is possible to adjust the cam shaft N to lead (or trail) relative to the crankshaft via the rotor 10 and, by reversing the pressure conditions, to adjust the cam shaft N to trail (or lead) relative to the crankshaft via the rotor 10.

In FIG. 3, the upper sectional half shows the connection between the working port A and the pressure chambers $K_1$, and the lower sectional half shows the pressure port P and feed channels of the downstream feed portion 15 which adjoin the deflecting portion 44 (FIG. 2) at their upstream ends and emerge downstream into the pressure port P. In the state shown, the pressure chambers $K_1$ are charged with the pressure fluid via the respectively assigned connecting channel 16, while the pressure chambers $K_2$ are connected to a pressure fluid reservoir and are correspondingly relieved of pressure.

Bore portions 15*b* which are shown in FIG. 3 emerge into the pressure chambers $K_2$, but are sealed by the holding device 40, as also shown in FIG. 2, and merely represent a certain dead volume. The disadvantage of a dead volume is more than made up for by a reduction in the production effort for producing the feed portion 15. When manufacturing the rotor 10, the feed channels of the feed portion 15 can be produced in a very simple way as transit bores in the rotor hub 11 and sealed by the holding device 40. Multiple simple bores, preferably radial bores, thus extend from the outer circumference 11*c* to the inner circumference 11*a* of the rotor hub 11. The portions of these transit bores which extend from the accommodating space 13 up to the outer circumference 11*c* of the rotor hub 11 are sealed off by means of the holding device 40 on an inner circumference

11*b* (FIG. 5) of the rotor hub 11 which surrounds the accommodating space 13. This creates, on the radially inner side, the feed channels which extend from the inner circumference 11*a* of the rotor hub 11 up to and into the accommodating space 13 and form the feed portion 15, each in the form of an inner bore portion, and on the radially outer side, the blind bore portions 15*b* which are sealed by the holding device 40.

FIG. 4 shows the phase setter of the first example embodiment, in the longitudinal section B-B in FIG. 3. The section B-B extends, from the radially outer side, initially through the stator 1 and then through one of the rotor vanes 12 (and, in the process, through a locking pin 28 which is accommodated in the relevant rotor vane 12 such that it can axially shift), from the locking pin 28 a short distance in a circumferential direction up to the level of one of the connecting channels 16, then through the relevant connecting channel 16 and further radially inwards towards the rotational axis R and from there, axially level with the pressure port P, through the feed portion 15 outwards in a straight line.

In an accommodating space of the stator ring 2 which is open on its end-facing side, the locking pin 28 is arranged such that it can axially shift and is tensed axially towards the stator cover 6 by a locking spring 29. The stator cover 6 comprises a local recess which the locking pin 28 can enter when the rotor 10 assumes a particular rotational angular position relative to the stator 1. A lock is particularly desirable when there is still air in the pressure chambers, such as for instance when an engine is started, or when particularly low pressures prevail, again such as when the engine is started. The recess in the stator cover 6 is charged with the pressure fluid, such that when a particular minimum pressure is reached, the locking pin 28 is pressed out of the recess, against the force of the locking spring 29, and the lock is thus released. A relief channel 29*a* serves to drain leakage fluid from the region of the accommodating space in which the locking spring 29 is arranged.

The section in FIG. 4 also in particular shows one of the connecting channels 17, via which the working port B is connected to one of the second pressure chambers $K_2$. The connecting channels 17 can be linear bores, which is favourable in terms of production, which extend through the rotor hub 11 from the outer circumference 11*c* to the inner circumference 11*a* of the rotor hub 11. The connecting channels 17 are preferably radial bores.

The isometric representation in FIG. 5 shows the rotor 10, the reflux valve device 50, the dirt filter 55, the holding device 40, the closure cover 39 and also the locking pin 28 and the locking spring 29, lined up axially in a view into the accommodating space 13 of the rotor 10 which is open towards the rear. The rotor 10, the reflux valve device 50, the dirt filter 55, the holding device 40 and the closure cover 39 form the rotor unit 100 when assembled, wherein the reflux valve device 50, the filter 55 and the holding device 40 are accommodated in the accommodating space 13 of the rotor 10.

The accommodating space 13 sub-divides the rotor hub 11 axially into a front axial portion, which faces the cam shaft N, and a rear axial portion which extends axially as far as the inner end-facing surface 18 of the rotor. The end-facing surface 18 of the rotor is a bottom surface of the accommodating space 13. The accommodating space 13 sub-divides the rear axial portion into an inner ring, which comprises the inner circumference 11*a*, and an outer ring which surrounds the inner ring and forms the outer circumference 11*c* of the rotor hub 11. The inner connecting portions 16.1 of the connecting channels 16 (FIG. 2) extend through the inner ring as passages which are open on their rear side, and the outer connecting portions 16.2 of the connecting channel 16 extend through the outer ring into the respective first pressure chamber $K_1$ (FIGS. 2 and 3). The bore portions of the feed portion 15 traverse the inner ring of the rotor hub. The bore portions 15*b* traverse the outer ring of the rotor hub 11.

Each of the connecting channels 17 extends in the front axial portion of the rotor hub 11 from the inner circumference 11*a* up to the outer circumference 11*c* of the rotor hub 11 and emerges on the outer side into the second pressure chamber $K_2$ (FIGS. 3 and 4) assigned to the respective connecting channel 17. The connecting channels 17 thus lead from the respective pressure chamber $K_2$ to the working port B via the shortest route in a straight line. Two of the channel portions 14*b* of the feed portion 14 which is upstream in the rotor unit 100, which emerge into the accommodating space 13, are also shown. The feed channels 14*a*, 14*b* of the feed portion 14, which are respectively composed of the channel portions 14*a* (FIG. 2) and 14*b*, are offset at an angle to the connecting channels 17. Each of the assembled feed channels 14*a*, 14*b* respectively extends between two connecting channels 17 which are adjacent in a circumferential direction.

The reflux valve device 50 is an axially thin valve structure 51 which is shaped as an annular disc and extends around the rotational axis R when fitted, as shown in FIGS. 1 to 4. The valve structure 51 is circumferentially closed on the radially inner side, which is advantageous with regard to fitting it, but is not essential in order for it to perform its function. Multiple spring-elastic valve tongues, hereinafter "spring tongues" 52, extend around the inner ring 52*a* formed in this way, successively in a circumferential direction, and can be elastically bent in an axial direction. The spring tongues 52, which can be bent and thus axially moved, are isolated from the inner ring 52*a* of the valve structure 51 by radially narrow clearances 53 which are elongated in a circumferential direction. Starting from a root region of the respective spring tongue 52 which adjoins the ring 52*a*, the clearances 53 extend in a circumferential direction and then taper radially outwards. The reflux valve device 50 and/or valve structure 51 as a whole exhibits the shape of an annular disc which is sub-divided by the narrow clearances 53 into the ring 52*a* and the spring tongues 52 which project radially from it in the respective root region and then extend in a circumferential direction. The spring tongues 52 form the outer circumference of the valve structure 51. The spring tongues 52 can be correspondingly dimensioned so as to have a large area.

In order to position the reflux valve device 50 relative to the holding device 40 and, via the latter, relative to the channel segments of the feed portion 14 in a circumferential direction, the valve structure 51 is provided with engaging structures 54 which co-operate with valve engaging structures 49 (FIG. 6) of the holding device 40. Advantageously, the reflux valve device 50 is not only positioned but also held on the holding device 40 by means of the engaging structures 54, which can make fitting it easier.

The channel portions 14*b* of the feed portion 14 are elongated in a circumferential direction, i.e. the flow cross-section of the respective channel portion is wider in a circumferential direction than in a radial direction. On the one hand, this provides an advantageously large flow cross-section for pressure fluid flowing to the pressure port P. On the other hand, the elongated cross-sectional shape of the channel portions 14*b* is adapted to the spring tongues 52 of the reflux valve device 50 which are likewise elongated in a circumferential direction. Due to the elongated cross-section of the channel portions 14*b* of the feed portion 14, fluid flows onto a large area of the spring tongues 52.

A Reed valve is respectively formed by means of the spring tongues 52 in the region where one of the channel portions 14*b* of the feed portion 14 transitions into the adjoining deflecting portion 44.

The holding device 40 is sleeve-shaped. It comprises a front axial portion 41, which axially faces the reflux valve device 50, and a rear axial portion 42 which protrudes from the front axial portion 41. The axial portion 41 is adapted to the shape and dimensions of the accommodating space 13, such that when fitted, the holding device 40 separates the feed 14, 15, 44 from the connecting channels 16 in the region of the axial portion 41 and seals the radially outer bore portions 15*b* (FIG. 2). The comparatively narrower axial portion 42 axially adjoins the axial portion 41 directly. The connecting portions 46 traverse the axial portion 42. When fitted, they overlap axially and in a circumferential direction with the inner connecting portions 16.1 and the outer connecting portions 16.2 of the rotor 10. Like the inner connecting portions 16.1, they are open on the rearward end-facing side of the holding device 40, i.e. the connecting portions 46 terminate in an opening on the rearward end-facing side of the holding device 40.

A front facing end of the holding device 40 which faces the closure cover 39 comprises an equalising structure 47 which serves to compensate for production tolerances and fitting tolerances and optionally also to compensate for different thermal expansions of the rotor 10 and the holding device 40. The equalising structure 47 is formed by a radially narrow projection on the rear end-facing surface of the axial portion 42. The equalising structure 47 is annular. It extends around the rotational axis R and is interrupted only by the connecting portions 46 which are open at the rear facing end. In modifications, the equalising structure 47 can be formed by means of a circumferential furrow-shaped recess or by multiple axially protruding studs which are arranged in a distribution over the circumference. When fitted, the closure cover 39 presses against the equalising structure 47, which is correspondingly deformed when being fitted but which advantageously still exhibits, once fitted, an elasticity which is sufficient to compensate for differences in thermal expansion.

The dirt filter 55 is likewise sleeve-shaped. It comprises a sleeve-shaped filter screen 56 and a supporting structure 57 comprising supporting rings between which the filter screen 56 extends around the rotational axis R (FIG. 2). The supporting structure 57 also comprises radially protruding engaging structures 58 for establishing a positive-fit and optionally also frictional-fit holding engagement with filter engaging structures 48 (FIG. 6) of the holding device 40.

The closure cover 39 is a thin annular disc comprising a circumferential recess near the outer circumference, wherein the recess is produced by reshaping and provides a lip on the outer circumference of the closure cover 39 and rigidifies the closure cover 39. When assembled, the closure cover 39 is placed in the axially rearward end of the accommodating space 13, and its lip which is circumferential on the outer side presses against an inner circumference 11*b* of the rotor hub 11. This seals off the accommodating space 13 on the outer circumference of the closure cover 39, as shown for instance in FIG. 2.

Figure 6:
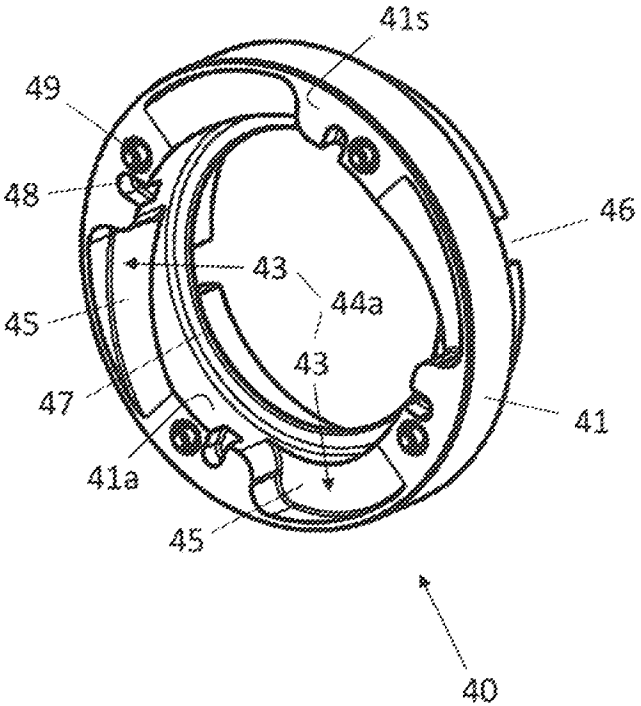
FIG. 6 a rotor and a holding device of the first example embodiment, in an isometric representation.
Figure 6:
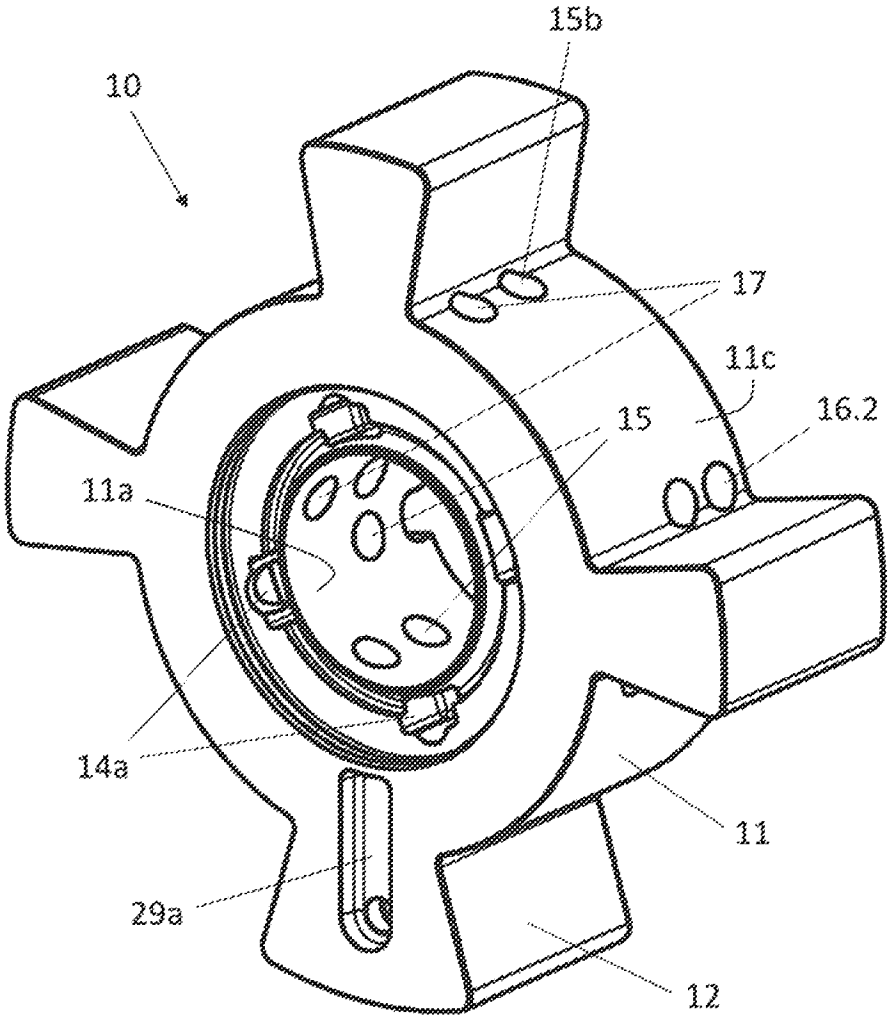
Figure 7:
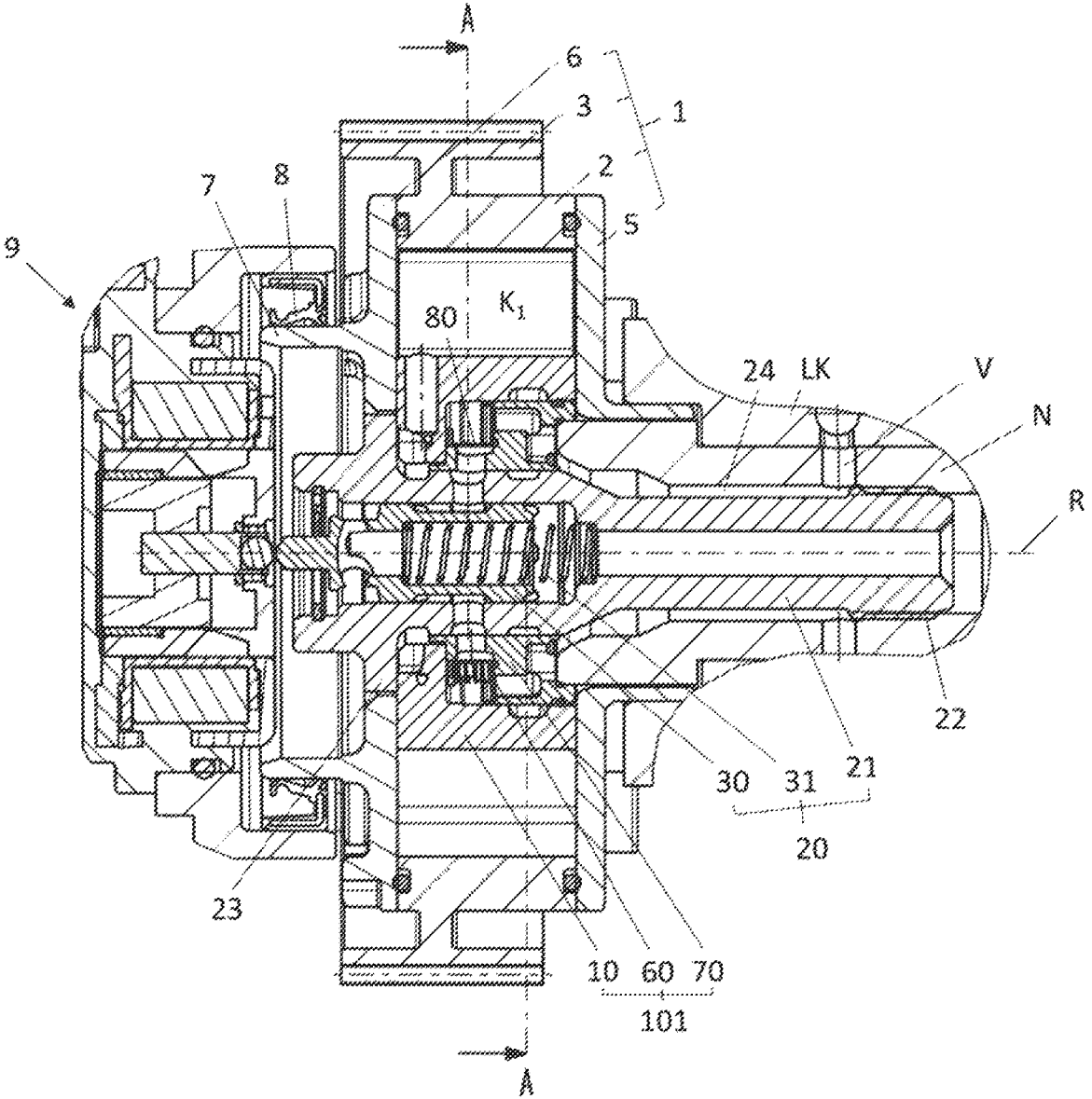
FIG. 7 a phase setter of a second example embodiment, fitted on a cam shaft, in a longitudinal section.

The rotor 10 and the holding device 40 are lined up along the rotational axis R in the isometric representation in FIG. 6. The other components of the rotor unit 100, for example the reflux valve device 50, are not shown for reasons of simplicity. FIG. 6 is a view onto the inflow and/or feed side of the rotor 10 and holding device 40.

The upstream channel portion 14*a* of each of the feed channels 14*a*, 14*b* of the feed portion 14 of the rotor 10 is shown, wherein the upstream channel portion 14*a* emerges on a front outer end-facing surface of the rotor 10. When fitted, said end-facing surface of the rotor 10 is pressed axially against an end-facing surface of the cam shaft N by means of the valve housing 21, as shown in FIG. 2. The upstream channel portions 14*a* of the feed channels 14*a*, 14*b* of the feed portion 14 are narrower in a circumferential direction than the downstream channel portions 14*b*.

The end-facing side 41*s* of the holding device 40, which axially faces the inner end-facing surface 18 (FIGS. 2, 4 and 5) of the rotor 10 when assembled, comprises multiple axial recesses 43 in a distribution over the circumference, wherein said recesses 43 together form the inflow region 44*a* of the deflecting portion 44. When assembled, the recesses 43 overlap in a circumferential direction with the channel segments 14*b* of the feed portion 14. They are each delineated on the radially outer side by a circumferential wall of the holding device 40. The recesses 43 are open, radially inwards, on the inner circumference 41*a*. The recesses 43 are delineated in an axial direction by end-facing bases, i.e. segmental end-facing surfaces, of the holding device 40. The bases form contact surfaces 45 for the spring tongues 52 of the reflux valve device 50 (FIG. 5). The recesses 43 are thus also yielding spaces into which the spring tongues 52 can yield until the respective spring tongue 52 comes to rest against the axially facing contact surface 45. In this respect, the spring tongues 52 and the corresponding contact surfaces 45 can be embodied as is known from other applications of Reed valves.

The contact surfaces 45 each extend at an axial inclination in a circumferential direction, such that the axial depth of the respective recess 43 increases in a circumferential direction from a flat region up to a deep region. As is preferred, the depth respectively increases continuously in a circumferential direction, starting from the front end-facing surface 41*s* of the holding device 40. The contact surfaces 45 are correspondingly inclined continuously in an axial direction. The angle of inclination of the contact surfaces 45 can in particular be constant, such that the contact surfaces 45 are oblique surfaces. In modifications, the angle of inclination can however also vary, for example progressively increase in a circumferential direction starting from the respective flat region, such that a contact surface 45 shaped in this way is convexly bulged in an axial direction in relation to the opposing spring tongue 52. The contact surfaces 45 axially slope continuously from the end-facing surface 41*s* into the respective recess 43. In such embodiments, the spring tongues 52 are placed onto the assigned contact surface 45 over their whole area. When they yield, the respective spring tongue 52 rolls off on the assigned contact surface 45.

As it flows through the inflow region 44*a*, the pressure fluid experiences a deflection in a circumferential direction because the depth of the recesses 43 increases in a circumferential direction, i.e. a tangential directional component (a rotational impulse) relative to the rotor unit 100 is imposed on the pressure fluid in the inflow region 44*a*. As it flows through the deflecting portion 44, the pressure fluid therefore exhibits a tangential directional component in the outflow region 44*b*, in particular in the annular gap between the dirt filter 55 and the inner circumference 41*a* of the holding device 40. In the annular gap around the dirt filter 55, therefore, not only the centrifugal forces caused by the rotational movement of the rotor unit 100 but also tangential forces which relieve the dirt filter 55 act on the dirt particles contained in the pressure fluid.

As already mentioned, the recesses 43 are open radially inwards towards the inner circumference 41*a*, such that the pressure fluid in the inflow region 44*a* of the deflecting portion 44 is deflected, at the spring tongues 52 which are bent into the recesses 43, from an at least substantially axial inflow direction, radially inwards towards the rotational axis R.

The rotor unit 100 comprising the rotor 10, the holding device 40, the reflux valve device 50 and the dirt filter 55 forms a fitted unit. In order to be able to handle them as a unit, i.e. a fitted unit, the components mentioned are advantageously held on each other in a releasable holding engagement. It is advantageous if the reflux valve device 50 and the dirt filter 55 are held on the holding device 40 in a holding engagement with the holding device 40 even before the rotor unit 100 is assembled, and for the holding device 40, reflux valve device 50 and dirt filter 55 to comprise mutually adapted engaging structures for establishing the respective holding engagement. The rotor unit 100 is completed by the closure cover 39 which is expediently pressed into the accommodating space 13 of the rotor 10 in order to ensure that the components of the rotor unit 100 are firmly held together in a pressing fit.

FIG. 6 shows the filter engaging structures 48 for the dirt filter 55 which are formed on the front end-facing side 41*s* of the holding device 40. The filter engaging structures 48 are formed on the front end-facing surface 41*s* as recesses into which the engaging structures 58 of the dirt filter 55 can be inserted. When the structures 48 and 58 are in engagement, the dirt filter 55 is advantageously held on the holding device 40 in a positive fit and/or frictional fit. The valve engaging structures 49, which protrude in the shape of pins or studs on the front end-facing side 41*s* of the holding device 40 in a distribution in a circumferential direction, are also shown. The valve engaging structures 49 serve to position and hold the reflux valve device 50, by engaging with the engaging structures 54 (FIG. 5) of the reflux valve device 50. In the example embodiment, they protrude through the engaging structures 54 of the reflux valve device 50, such that they also serve an additional function of positioning the holding device 40 relative to the rotor 10, i.e. in order to position the recesses 43 in relation to the circumferential direction relative to the channel segments 14*b* of the feed portion 14 of the rotor 10. This positioning engagement is also preferably a holding engagement in which the holding device 40 together with the reflux valve device 50 and the dirt filter 55 is held on the rotor 10, in order to make it easier to assemble the phase setter.

As already mentioned, arranging the holding device 40 in the accommodating space 13 of the rotor 10 makes it easier to produce the feed channels and connecting channels which cross the rotor unit 100, and in particular easier to produce the downstream feed portion 15 and the connecting channels 16. The rotor hub 11 with its projecting rotor vanes 12 can then be formed as a cast part in a casting method or advantageously as a sintered part by pressing and sintering. The rotor 10 can be a plastic part or, as is preferred, a metal part or a plastic part comprising one or more embedded metal structures. The cast or sintered part can already comprise the accommodating space 13. Alternatively, the accommodating space 13 can be produced by machine-cutting the cast or sintered part. The connecting portions 16.1 and 16.2 of the connecting channels 16 and/or the connecting channels 17 and/or the feed channels of the feed portion 15 which emerges at the inner circumference 11*a* of the rotor hub 11 can each be produced as linear, radial or at least substantially radial bores which traverse the rotor hub 11 from the radially outer side to the radially inner side. If, as is preferred, the rotor 10 is a sintered part, the connecting channels 16 and/or the connecting channels 17 and/or the feed channels of the feed portion 15 can be produced particularly cheaply by drilling the compact, i.e. the powder compact which has been pressed into shape. The outer bore portions 15*b* are sealed in the accommodating space 13 by the holding device 40. The connecting portions 16.1 and 16.2 of the connecting channels 16 are separated from the feed 14, 15, 44 in the accommodating space 13 by means of the holding device 40.

FIGS. 7 to 12 show a phase setter of a second example embodiment. The same sections and isometric representations have been chosen as in the first example embodiment. The phase setter, which is shown completely in FIG. 7, corresponds to the first example embodiment in relation to its stator 1, control valve 20 and electromagnetic device 9. The pressure fluid supply via the cam shaft N and the annular supplying portion 24 corresponds to the pressure fluid supply of the first example embodiment. In relation to the identically designed components and the pressure fluid supply, reference is therefore made to the statements made regarding the first example embodiment. Differences do however exist with regard to the rotor unit, which comprises: a rotor 10 which has been modified in the region of the rotor hub 11; a modified holding device 60; a modified reflux valve device 70; and a modified dirt filter 80.

Figure 8:
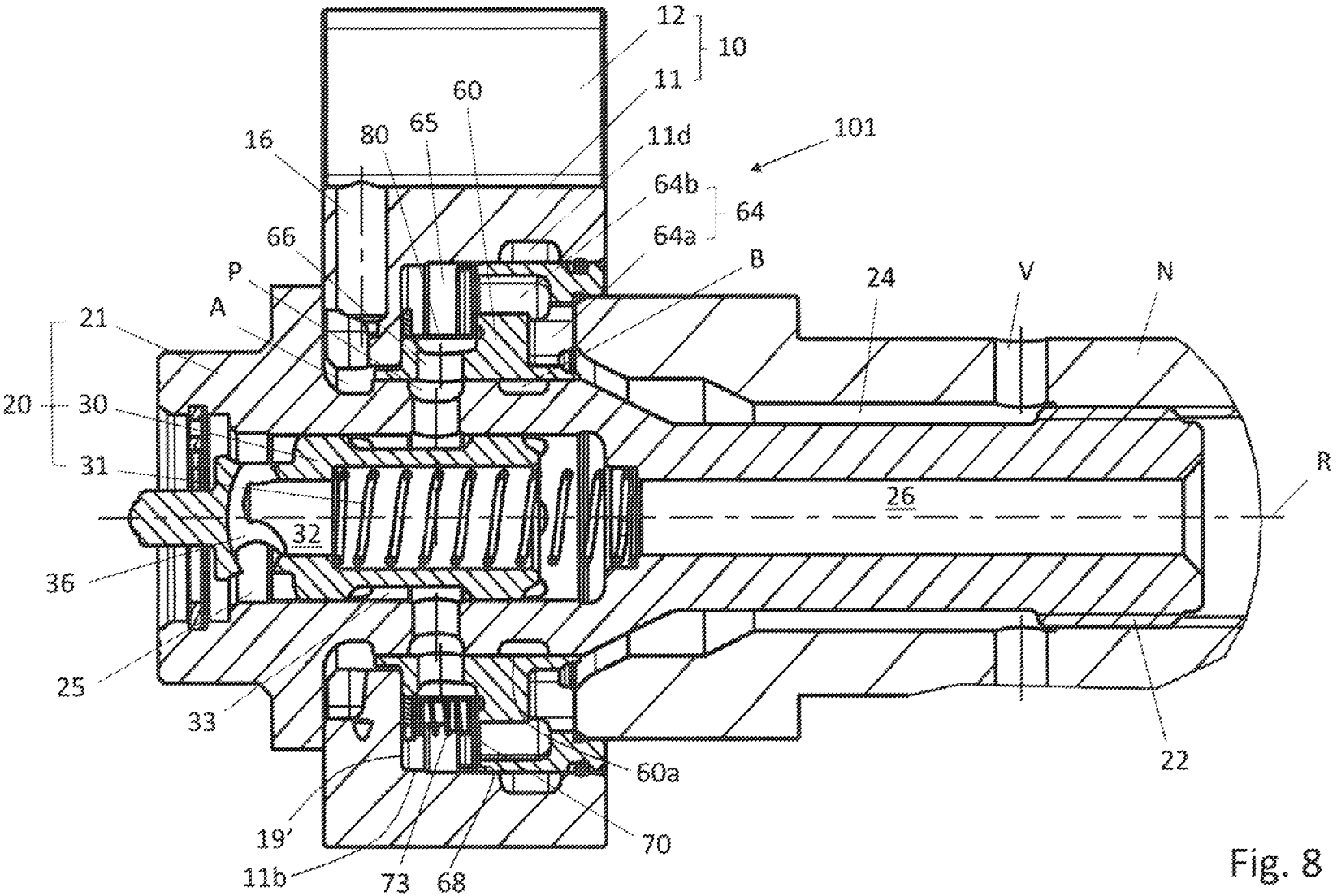
FIG. 8 components of a rotor unit of the phase setter of the second example embodiment, which are non-rotationally connected to the cam shaft, in the longitudinal section in FIG. 7.

FIG. 8 shows the rotor unit 101 of the second example embodiment, when fitted on a cam shaft N. The stator 1 and the electromagnetic device 9 and also the bearing body LK (FIG. 7) are not shown.

The rotor 10 comprises a central axial passage through which the valve housing 21 protrudes. The passage narrows in steps from a front axial portion, which adjoins the cam shaft N, to a rear axial portion 42, wherein it forms an end-facing surface 19' which faces the cam shaft N. The wide front axial portion of the passage forms an accommodating space 19 (FIG. 12) for the holding device 60. Unlike the accommodating space 13 of the first example embodiment, the accommodating space 19 is therefore not formed within the rotor 10 but rather radially between the rotor 10 and the valve housing 21. Correspondingly, the holding device 60 forms an inner circumference 60*a* of the rotor unit 101, which immediately surrounds the outer circumference of the valve housing 21 in the region of the pressure port P and working port B and thus establishes the pressure fluid connection between the rotor unit 101 and the control valve 20.

The rotor 10 comprises first connecting channels 16 which extend through the rotor hub 11 and connect the working port A to one of the first pressure chambers $K_1$, respectively. Unlike the first example embodiment, the connecting channels 16 extend over their entire length from the inner circumference 11*a* to the outer circumference 11*c* (FIG. 11) of the rotor hub 11.

In the second example embodiment, the feed which connects the supplying portion 24 to the pressure port P extends in sections through the holding device 60. For instance, an upstream feed portion 64 which extends from the supplying portion 24 as far as the reflux valve device 70 extends through the holding device 60. As in the first example embodiment, the upstream feed portion 64 comprises an upstream channel portion 64*a*, which immediately adjoins the supplying portion 24, and a downstream channel portion 64*b* which adjoins the upstream channel portion 64*a* further on the radially outer side within the holding device 60 and extends as far as the reflux valve device 70.

In the inflow direction to the pressure port P, the feed portion 64 is adjoined in the central passage of the rotor 10 by a deflecting portion 65 in which the pressure fluid which is axially inflowing through the feed portion 64 is deflected towards the rotational axis R and the pressure port P. The reflux valve device 70 acts in the region where the feed portion 64 transitions into the deflecting portion 65. The deflecting portion 65 is an annular space which extends around the rotational axis R and which is delineated on the radially outer side by an inner circumference 11*b* of the rotor 10 and on the radially inner side by the holding device 60. The end-facing surface 19' of the rotor 10 delineates the deflecting portion 65 on one end-facing side. When fluid is not flowing through it, the reflux valve device 70 delineates the deflecting portion 65 on the other end-facing side.

The deflecting portion 65 is adjoined on the radially inner side across the dirt filter 80 by the downstream feed portion 66 which extends through the holding device 60 up to the pressure port P.

In the second example embodiment, the rotor 10 can be configured very simply with regard to the feed 64, 65, 66 due to the holding device 60. The inner circumference 11*b* and end-facing surface 19' of the rotor hub 11 merely delineate the deflecting portion 65.

Figure 9:
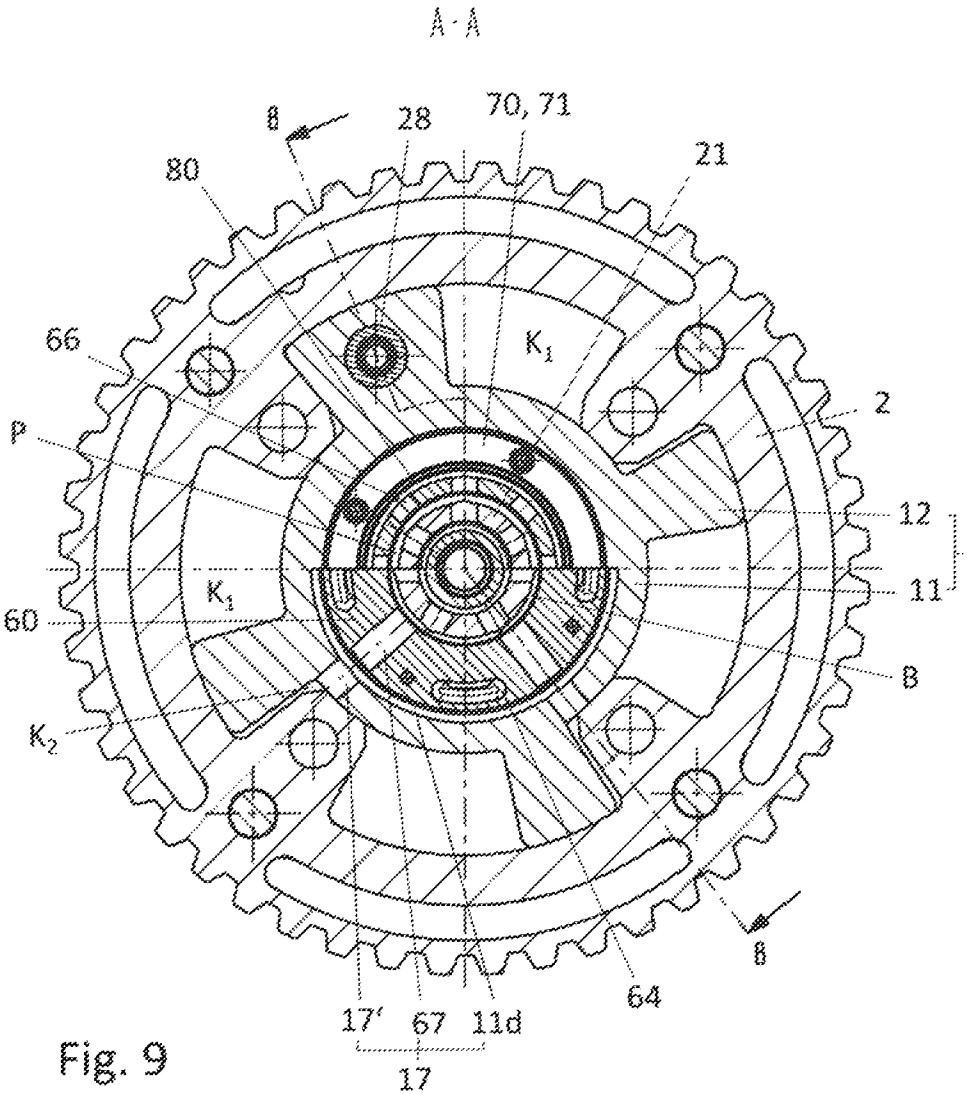
FIG. 9 the cross-section A-A in FIG. 7.

In the cross-section in FIG. 9, the lower sectional half shows the connection between the working port B and the pressure chambers $K_2$. In the state shown, the pressure chambers $K_1$ are charged with the pressure fluid via the connecting channels 16 (FIG. 2), while the pressure chambers $K_2$ are connected to the pressure fluid reservoir via the respectively assigned connecting channel 17 and are correspondingly relieved of pressure. The connecting channels 17 are each composed of an inner channel portion 67 which extends through the holding device 60, an outer channel portion 17' which extends through the rotor hub 11, and an annular gap 11*d* of the rotor hub 11. The annular gap 11*d* extends around the rotational axis R on the inner circumference 11*b* of the rotor hub 11. The channel portions 17' of the holding device 60 emerge from the radially inner side, and the channel portions 67 emerge from the radially outer side, into the annular gap 11*d*. The lower sectional plane in FIG. 9 respectively shows a channel segment 64*b* of the feed portion 64, which is elongated in a circumferential direction, between connecting channels 17 which are adjacent in a circumferential direction. In the second example embodiment, the channel segments 64*a*, 64*b* (FIG. 2) of the feed portion 64 cross the radially inner channel portions 17' of the connecting channels 17 in the holding device 60, each at a distance as measured in a circumferential direction. The feed portion 64 is thus separated from the connecting channels 17 within the holding device 60.

Figure 10:
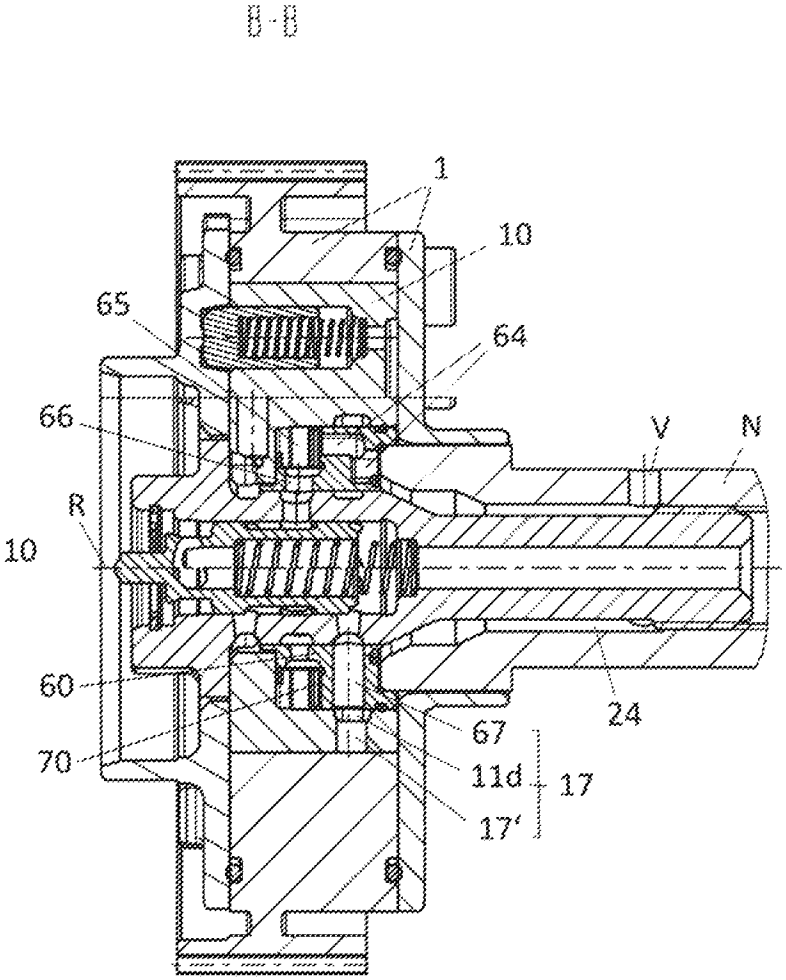
FIG. 10 the longitudinal section B-B in FIG. 9.

FIG. 10 shows the phase setter of the second example embodiment, without the electromagnetic device 9 (FIG. 1), in the section B-B in FIG. 9. The section extends in the upper sectional half, above the rotational axis R, through the pressure port P and extends in the lower sectional half through the working port B and the connecting channels 17, such that the aligned arrangement of the channel portions 67 and 17' is shown, as in the cross-section in FIG. 9.

Figure 11:
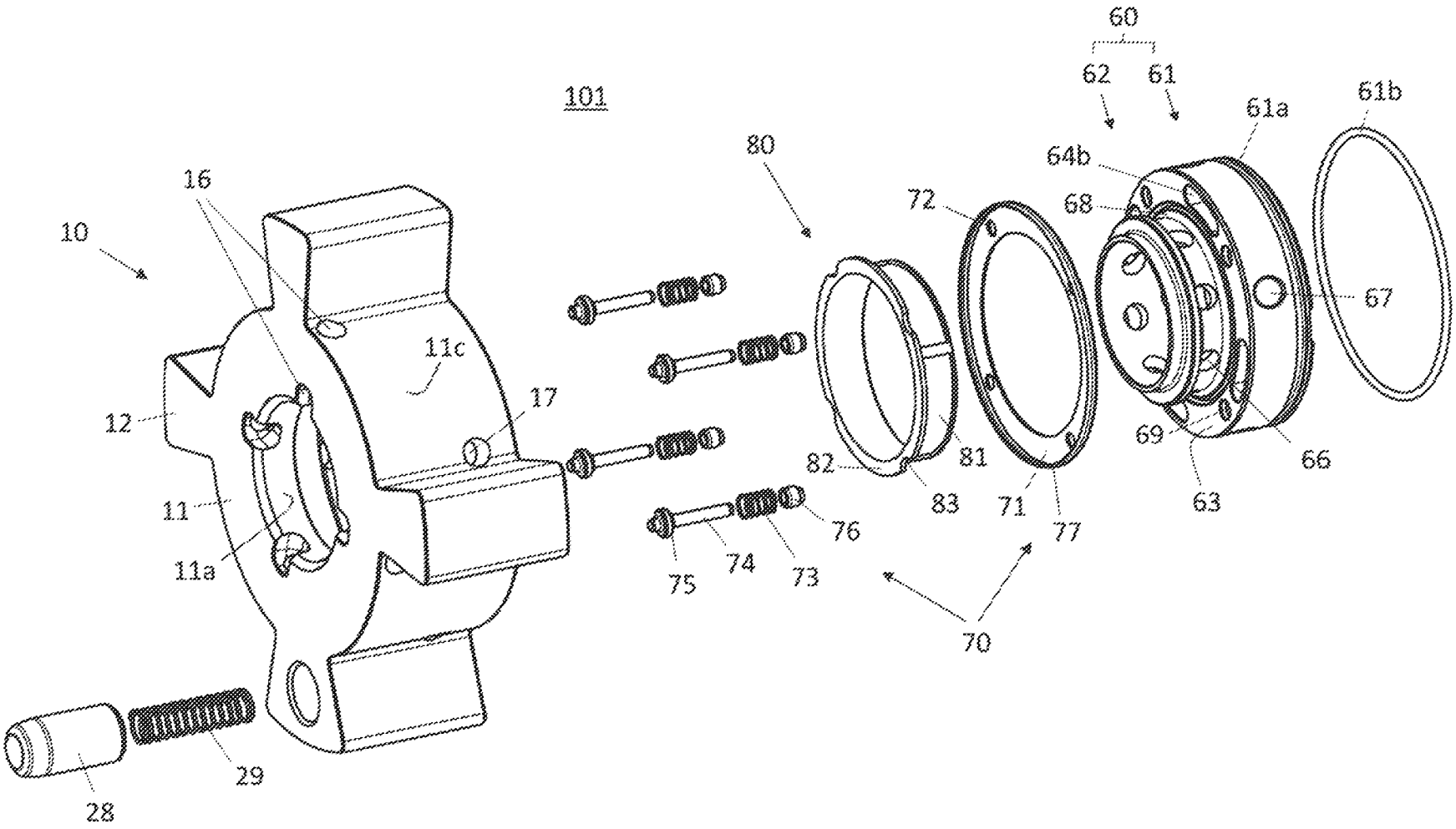
FIG. 11 components of the rotor unit of the second example embodiment, in an isometric representation.

The components of the rotor unit 101 of the second example embodiment are lined up axially, in the viewing direction onto the rear side of the rotor 10 which faces away from the cam shaft N, in the isometric representation in FIG. 11. The connecting channels 16 traverse the rotor hub 11 from the outer circumference 11*c* to the inner circumference 11*a*. The connecting channels 16 are transit bores which emerge on the outer circumference 11*c* at a slight axial distance from the facing end of the rotor hub 11 and, directly adjoining the inner circumference 11*a*, are axially elongated such that they open at the facing end of the rotor hub 11. When fitted, they are sealed at the facing end by means of the collar 23 of the valve housing 21 (FIG. 2).

The holding device 60 comprises a radially wide front axial portion 61 and a rear axial portion 62 which is radially narrower by comparison and axially protrudes from the front axial portion 61. In the front axial portion 61, which faces the cam shaft N when assembled, the channel portions 67 traverse the holding device 60 from the radially outer side to the radially inner side. The channel portions 64*a* (FIG. 8) and 64*b* of the feed portion 64 each extend in an axial direction in the axial portion 61 and emerge on a rearward end-facing surface 63 of the axial portion 61. The feed channels of the feed portion 66 extend through the rear axial portion 62 from the radially outer side to the radially inner side.

The reflux valve device 70 comprises a valve structure 71, which is shaped as an annular disc, and a spring/guiding device comprising multiple reflux valve springs 73 and multiple pin-shaped or bolt-shaped guiding elements 74. The guiding elements 74 are fastened to the holding device 60 by means of holding elements 76. The holding elements 76 can be inserted into recesses 69 which are formed on the end-facing surface 63 of the holding device 60. They serve to hold the guiding elements 74 on the holding device 60. The guiding elements 74 can for example be screwed to the holding elements 76. The ends of the guiding elements 74 which face away from the end-facing surface 63 comprise radial widenings which form a counter bearing 75 for each one of the reflux valve springs 73. When assembled, the guiding elements 74 on the end-facing surface 63 axially protrude from the holding device 60 freely, wherein they protrude through the valve structure 71 which comprises, for this purpose, a complementary guiding element 72 in the form of for example an axial passage for each of the guiding elements 74. The reflux valve springs 73 are each axially supported at one end on the valve structure 71 and axially supported at the other end on the counter bearing 75 of the respective guiding element 74. The spring forces are thus absorbed by the holding device 60.

When fitted, the valve structure 71 is charged with a spring force towards the end-facing surface 63 of the holding device 60. In accordance with the pressure conditions prevailing in the feed 64, 65, 66, the valve structure 71 is either pressed against the end-facing surface 63 and seals the channel portions 64*b* of the feed portion 64 against a backflow or is lifted off the end-facing surface 63, against the force of the reflux valve spring 73, such that pressure fluid can flow to the pressure port P. When the valve structure 71 and the guiding elements 74 are in guiding engagement, the valve structure 71 is axially guided on the guiding elements 74. In order to rigidify the valve structure 71 which can be axially moved back and forth as a whole, it is circumferentially provided with an outer rigidifying periphery 77 which is obtained by reshaping.

As in the first example embodiment, the dirt filter 80 comprises a sleeve-shaped filter screen 81, which extends around the rotational axis R, and a supporting structure 82 which frames the filter screen 81 on the left and right. When fitted, the filter screen 81 surrounds the holding device 60 in the region of the feed portion 66, wherein the supporting structure 82 is in a releasable and for example frictional-fit holding engagement with a filter engaging structure 68 of the holding device 60. The filter engaging structure 68 extends in the shape of a furrow around the rotational axis R on the end-facing surface 63. In the holding engagement, the supporting structure 82 of the dirt filter 80 protrudes axially into the filter engaging structure 68. The feed channels of the feed portion 66 emerge on an outer circumference of the holding device 60 which is radially set back, such that the filter screen 81 surrounds where the feed channels of the feed portion 66 emerge, at a certain radial distance, and the dirt filter 80 is radially supported in the region of the supporting structure 82 to the left and right of the feed portion 66. When fitted, the dirt filter 80—when it is in engagement with the filter engaging structure 68—is axially supported on the holding device 60 and axially supported on the other side on the end-facing surface 19' (FIG. 2) of the rotor 10 and thus axially secured. When fitted, the counter bearings 75 of the guiding elements 74 come to rest in radial recesses 83 of the dirt filter 80, such that there is no contact between the dirt filter 80 and the reflux valve springs 73.

In the axial portion 61 on the outer circumference axially next to the connecting channels 67, the holding device 60 circumferentially comprises a furrow 61*a* for accommodating a gasket ring 61*b*. The gasket ring 61*b* ensures that the joining gap which extends around the rotational axis R between the rotor 10 and the holding device 60, and the annular gap 11*d* which is circumferential in the region of the joining gap and connects the channel portions 17' and 67 (FIG. 10), are sealed within the rotor unit 101.

Figure 12:
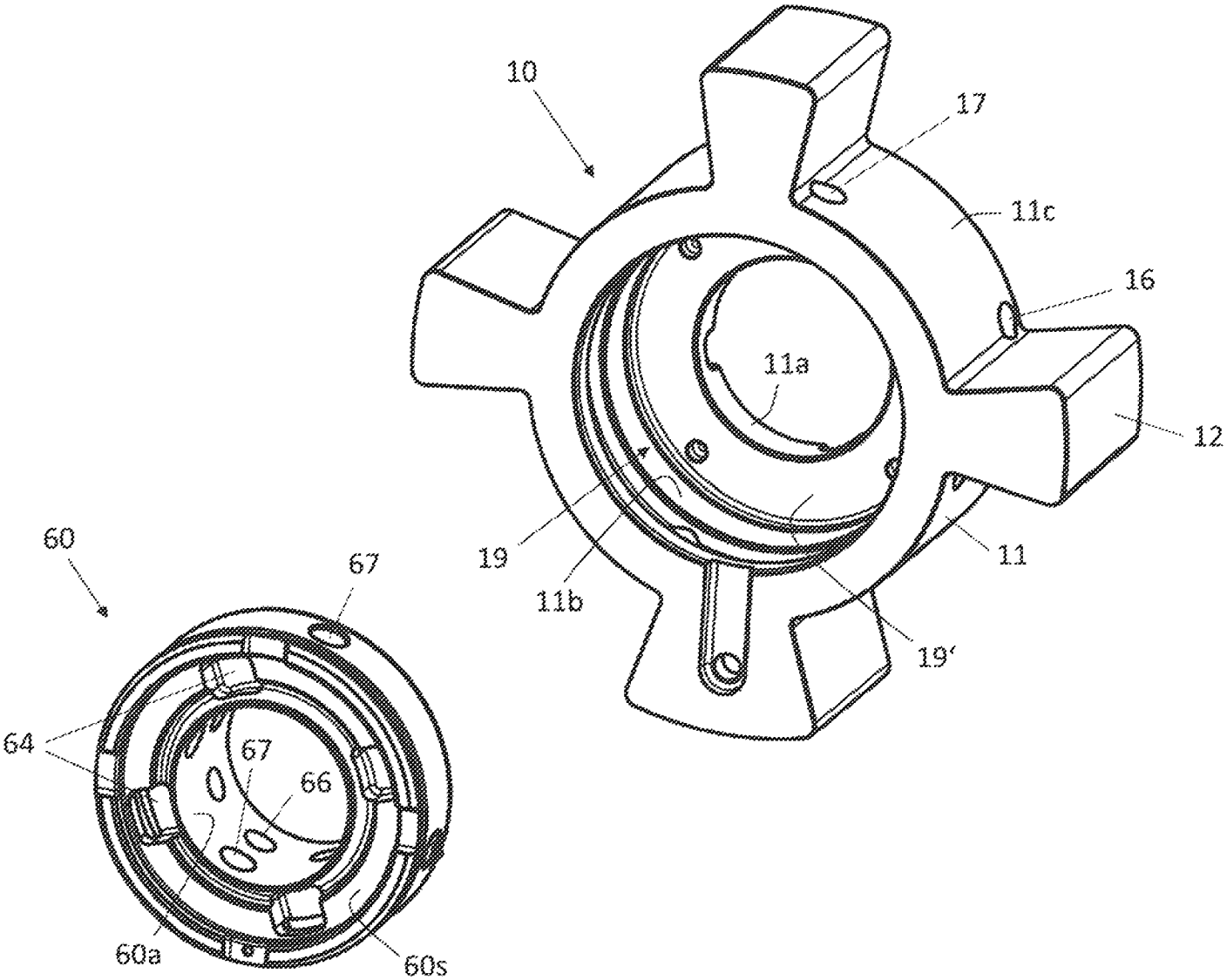
FIG. 12 a rotor and a holding device of the second example embodiment, in an isometric representation.

FIG. 12 shows just the rotor 10 and holding device 60 of the rotor unit 101 of the second example embodiment, axially lined up and in a view in an inflow direction of the pressure fluid and thus a view into the accommodating space 19 of the rotor 10.

Arranging the holding device 60 in the accommodating space 19 of the rotor 10 makes it easier to produce the feed channels and connecting channels which cross the rotor unit 101, and in particular easier to produce the deflecting portion 65 (FIG. 8). The feed portions 64 and 66 are directly provided in their entirety in the holding device 60. The rotor hub 11 with its projecting rotor vanes 12 can then be formed as a cast part in a casting method or advantageously as a sintered part by pressing and sintering. In the second example embodiment, the rotor 10 can again be a plastic part or, as is preferred, a metal part or a plastic part comprising one or more embedded metal structures. The cast or sintered part can already comprise the accommodating space 19. Alternatively, the accommodating space 19 can be produced by machine-cutting the cast or sintered part. The connecting channels 16 and/or the channel portions 17' can each be produced as linear, radial or at least substantially radial bores which traverse the rotor hub 11 from the radially outer side to the radially inner side.

The respective holding device 40 and/or 60 can be manufactured in one piece in an original-moulding method, preferably injection moulding. In preferred embodiments, the holding device 40 is a plastic injection-moulded part. In equally preferred alternative embodiments, the holding device 40 and/or the holding device 60 can be formed from a metal material, preferably a light metal. It also holds for the metallic holding device 40 and/or 60 that it is preferably formed in one piece in an original-moulding method, expediently by casting. In embodiments in which it is made of metal, the holding device 40 and/or the holding device 60 can in particular be an aluminium or zinc die-cast part.

Figure 14:
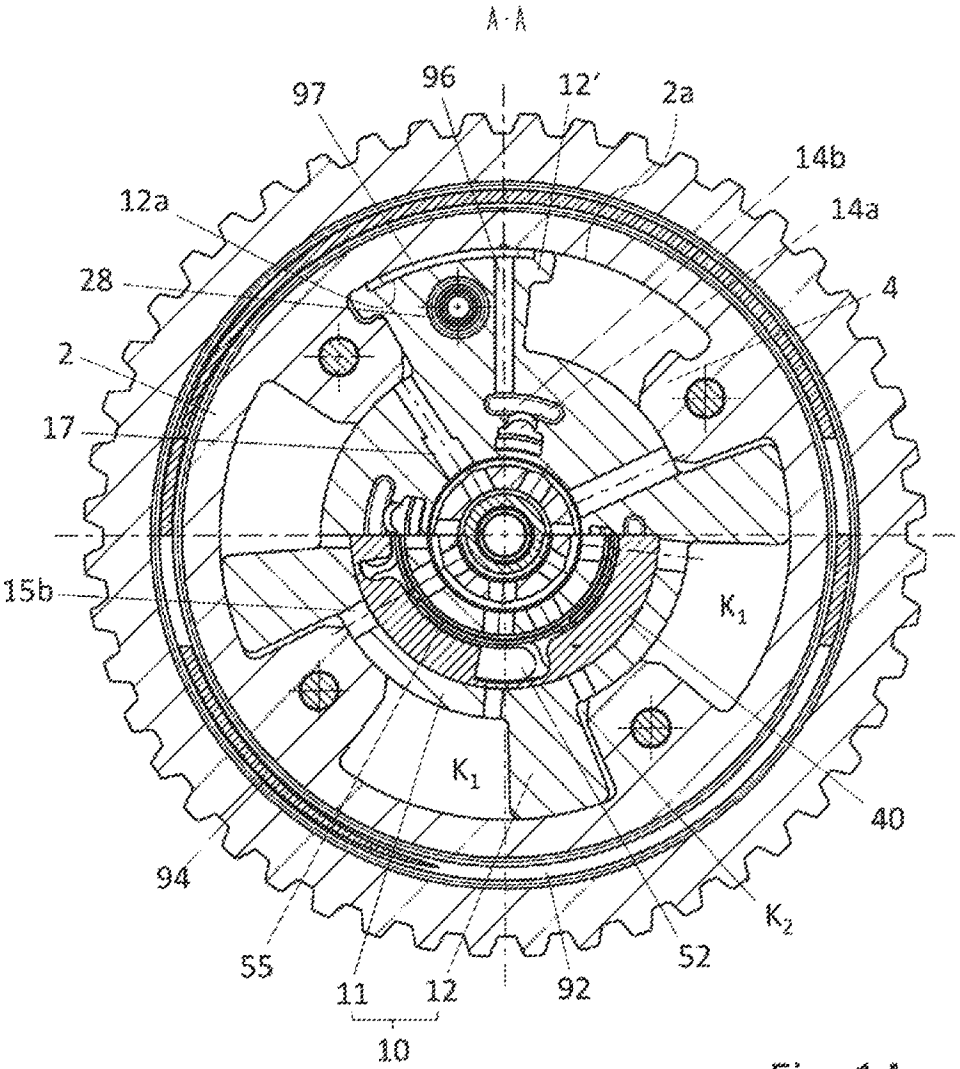
FIG. 14 the cross-section A-A in FIG. 13.
Figure 13:
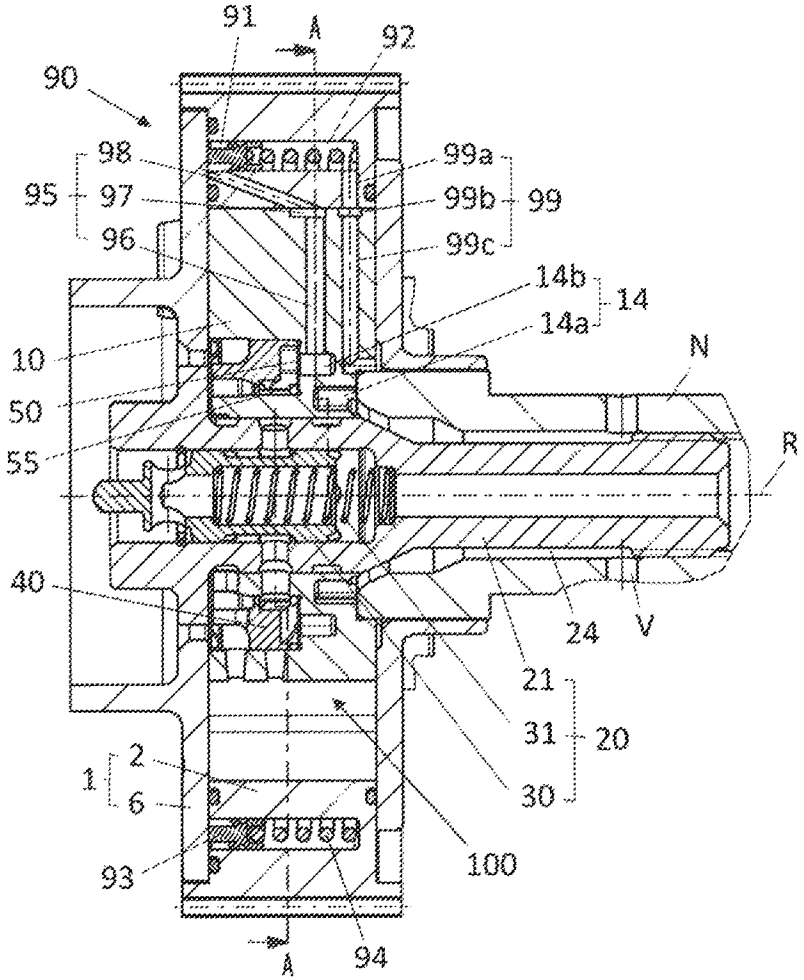
FIG. 13 a phase setter of a third example embodiment, in a longitudinal section.

FIGS. 13 and 14 show a phase setter of a third example embodiment, fitted on the cam shaft N. The phase setter is derived from the phase setter of the first example embodiment. For reasons of simplicity, the only parts of the phase setter shown are the stator 1 and the rotor unit which is non-rotationally connected to the cam shaft N. The phase setter of the third example embodiment differs from the phase setter of the first example embodiment only in relation to an integrated pressure storage 90. In order to obtain the pressure storage 90, the stator 1 and rotor 10 are modified, while the other components of the phase setter correspond to the functionally identical components of the first example embodiment, such that reference is made to the statements made in this respect regarding the first example embodiment. Because they are otherwise identical, the rotor unit is denoted by the reference sign 100, as in the first example embodiment.

The pressure storage 90 comprises a storage space which extends around the rotational axis R and in which a pressure storage piston 93 can be moved back and forth in an axial direction. The piston 93 axially sub-divides the storage space into a pressure volume 91 and a relief volume 92. The pressure volume 91 is connected to the pressure fluid supply, such that the pressure storage piston 93 can be charged with the pressurised pressure fluid on a side of the piston in the pressure volume 91. In the relief volume 92, a pressure storage spring 94 is accommodated which charges the pressure storage piston 93 with a restoring spring force counter to the pressure exerted by the pressure fluid.

The storage space 91, 92 is an annular gap which extends around the rotational axis R completely circumferentially in the stator ring 2 and is sealed at its open end-facing side by means of the stator cover 6. Instead of an annular gap which is completely circumferential around the rotational axis R, the storage space 91, 92 could also be formed as an annular gap segment which extends only partially around the rotational axis R or could be formed by multiple annular gap segments which each extend around the rotational axis R and which are arranged successively in a circumferential direction. Forming it as a completely circumferential annular gap does however simplify the pressure storage 90 in several respects. One annular piston which is completely circumferential around the rotational axis R is then sufficient as the pressure storage piston 93, and the pressure storage spring 94 can be provided in the form of a simple helical pressure spring. Just one storage feed channel 95 can ensure that the pressure volume 91 is supplied with pressure fluid. One storage relief channel 99 is sufficient for relieving the relief volume 92 of pressure. In principle, it would however also be possible, in the chosen embodiment, to provide two or more storage feed channels, comparable to the storage feed channel 95 of the example embodiment, and/or two or more storage relief channels, comparable to the storage relief channel 99 of the example embodiment, in a distribution over the circumference of the storage space 91, 92.

The pressure volume 91 is connected to the pressure fluid supply within the rotor unit 100. The storage feed channel 95 diverts from the feed 14, 15, 44 (FIG. 8). In the example embodiment, the storage feed channel 95 diverts from the upstream feed portion 14.

The storage feed channel 95 is composed of multiple channel portions 96, 97 and 98. The upstream channel portion 96 diverts from the feed portion 14—in the example embodiment, from one of the downstream channel segments 14*b* of the feed portion 14—immediately upstream of the reflux valve device 50. Starting from where it diverts, the channel portion 96 extends radially or at least substantially radially through the rotor hub 11 and through one of the rotor vanes 12 up to an outer circumference 12*a* of the relevant rotor vane which, in order to distinguish it, is denoted by 12'.

The outer circumference 12*a* of this rotor vane 12' comprises a recess which forms a pocket-shaped channel portion 97 which is elongated in the shape of a strip in a circumferential direction. The channel portion 96 emerges into the pocket-shaped channel portion 97 at the outer circumference 12*a* of the rotor vane 12'. The upstream channel portion 98 extends from the inner circumference 2*a* of the stator ring 2 into the pressure volume 91 and emerges from the radially outer side into the pocket-shaped channel portion 97. The inner circumference 2*a* lies directly opposite the outer circumference 12*a* of the rotor vane 12', radially facing it. The rotor vane 12' is in a sliding contact with the stator ring 2 in the region of the inner circumference 2*a*. When the rotor vane 12' and stator ring 2 are in sliding contact, the channel portion 97 is circumferentially sealed off, aside from unavoidable leakage losses, along its outer periphery.

The pocket-shaped channel portion 97 extends over at least the majority of the width of the rotor vane 12' as measured in a circumferential direction. The channel portion 97 is long enough in a circumferential direction that the channel portion 98 which extends in the stator ring 2 is connected to the channel portion 97 in every rotational angular position which the rotor 10 can assume relative to the stator 1, and the pressure fluid supply of the pressure storage 90 is ensured in every relative rotational angular position between the stator 1 and the rotor 10.

Where pressure fluid passes out of the pressure volume 91 across the pressure storage piston 93 into the relief volume 92 due to unavoidable leakage losses, such leakage fluid is drained via the storage relief channel 99. The storage relief channel 99 is likewise composed of multiple channel portions 99*a*, 99*b* and 99*c*. Starting from the relief volume 92, a channel portion 99*a* which is upstream in an outflow direction extends through the stator ring 2 up to and into a channel portion 99*b* which is likewise pocket-shaped and situated axially next to the channel portion 97 on the outer circumference 12*a* of said rotor vane 12' and which, like the channel portion 97, is long enough in a circumferential direction to maintain the connection to the relief volume 92 in every relative rotational angular position between the rotor 10 and the stator 1. A downstream channel portion 99*c* leads from the pocket-shaped channel portion 99*b* through the rotor vane 12'. In this downstream channel portion, the leakage fluid can flow off radially inwards and ultimately towards the pressure fluid reservoir.

The pocket-shaped channel portions 97 and 99*b* each extend in the shape of a strip, axially next to each other at a distance, on the outer circumference 12*a* of the same rotor vane 12'. The rotor vane 12' widens in a circumferential direction in its radially outer region, such that its outer circumference 12*a*, which is in sliding contact with the stator ring 2, is longer in a circumferential direction than the outer circumference of the other rotor vanes 12. The widening is favourable for sealing off the elongated pocket-shaped channel portions 97 and 99*b*, since this leaves more area for the seal at the ends of the channel portions 97 and 99*b* on the outer circumference 12*a*. In the example embodiment, the rotor vane 12' is mushroom-shaped in cross-section, with a bulge on both sides. The base regions of the adjacent stator vanes 4 respectively comprise an indentation on the side facing the rotor vane 12', which one of the bulges of the rotor vane 12' can enter when pivoted.

In the example embodiment, the storage feed channel 95 and the storage relief channel 99 extend through the same rotor vane 12'. In modifications, the storage channel 95 can extend through a first rotor vane 12, and the relief channel 99 can extend through another, second rotor vane 12.

For connecting the pressure volume 91 to the pressure fluid supply, it is advantageous for the feed portion 14 to comprise channel segments 14*b* which are elongated in a circumferential direction (FIG. 14). The large width of the channel segments 14*b* as measured in a circumferential direction makes it easier to provide the channel portion 96 as a simple linear radial bore, as shown for instance in FIG. 14. Reference may be made, merely peripherally, to the fact that the locking pin 28 is arranged in the rotor vane 12', next to the channel portions 96 and 99*c* in a circumferential direction. If greater demands are made for a minimum leakage of oil in the transition between the channel portion 97 and the channel portion 98 and/or channel portions 99*a* and 99*b*, respectively, the region of the outer circumference 12*a* can be sealed off on the left and right in a circumferential direction, and optionally around the pocket-shaped channel portion 97, by means of one or more sealing elements.

Figure 16:
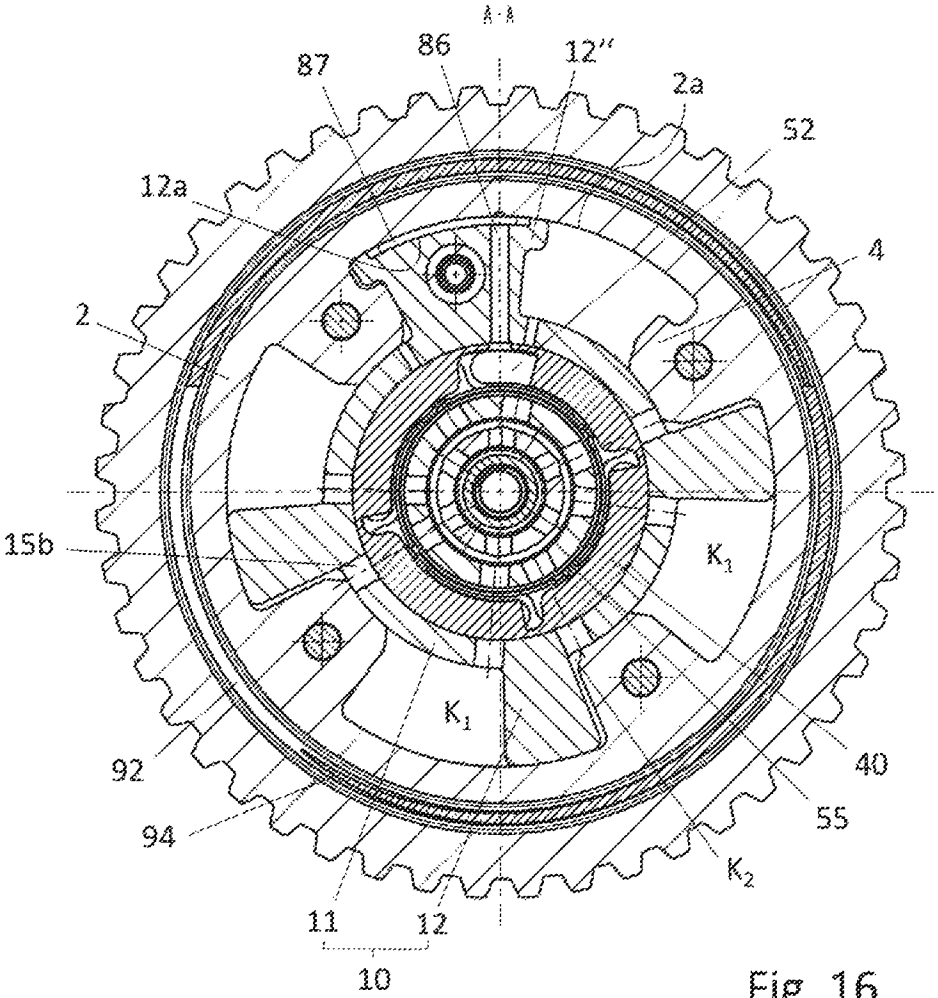
FIG. 16 the cross-section A-A in FIG. 15.
Figure 15:
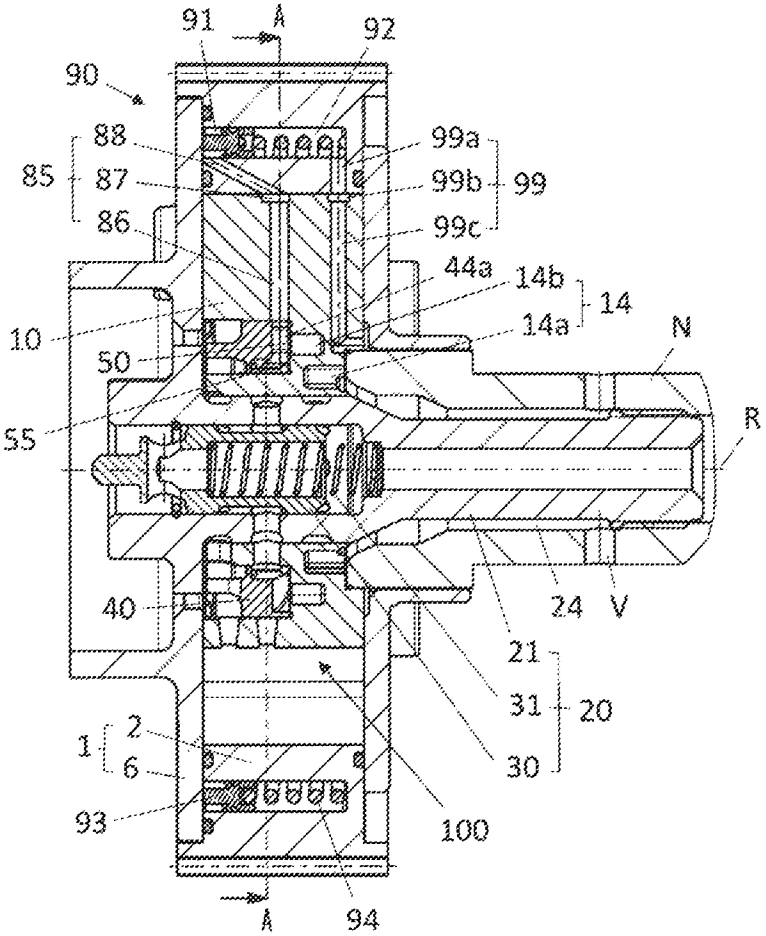
FIG. 15 a phase setter of a fourth example embodiment, in a longitudinal section.

FIGS. 15 and 16 show a phase setter of a fourth example embodiment. The phase setter is derived from the phase setter of the first example embodiment and differs from the first example embodiment by the integrated pressure storage 90 which corresponds to the pressure storage 90 of the third example embodiment with regard to the storage space 91, 92, the pressure storage piston 93, pressure storage spring 94 and the relief channel 99.

The phase setter of the fourth example embodiment differs from the phase setter of the third example embodiment only in that the pressure fluid for the pressure volume 91 in the rotor unit 100 is diverted from the feed 14, 15, 44 downstream of the reflux valve device 50. The storage feed channel is therefore denoted by 85.

The storage feed channel 85 comprises an upstream channel portion 86 which extends through the rotor hub 11 and, in a radial elongation, through one of the rotor vanes 12 and diverts from the feed 14, 15, 44 in the deflecting portion 44 and extends, from the location where it diverts, up to the outer circumference 12*a* of one of the rotor vanes 12. The relevant rotor vane is denoted in FIG. 16 by 12". The channel portion 86 emerges at the outer circumference 12*a* of the rotor vane 12" into a pocket-shaped channel portion 87 which is elongated in a circumferential direction and comparable to the channel portion 97 of the third example embodiment. The connection between the pressure volume 91 and the channel portion 97 is created by a channel portion 88 which extends in the stator ring 2 and which is comparable to the channel portion 98 of the third example embodiment. Aside from the diversion being formed differently, the descriptions regarding the third example embodiment are incorporated by reference.

The channel portion 86 diverts in the inflow region 44*a* of the deflecting portion 44. The channel portion 86 thus also comprises a sub-portion which extends through a circumferential wall of the holding device 40 and into one of the recesses 43 (FIG. 6) which together form the inflow region 44*a*.

Diverting downstream of the reflux valve device 50 means that the pressure volume 91 is secured by the reflux valve device 50 if a drop in pressure occurs upstream of the reflux valve device 50. Drops in pressure can occur in the pressure fluid system for example when connecting up additional pressure fluid consumers. By diverting downstream of the reflux valve device 50, momentary pressure fluctuations of this type can be bridged.

Figure 17:
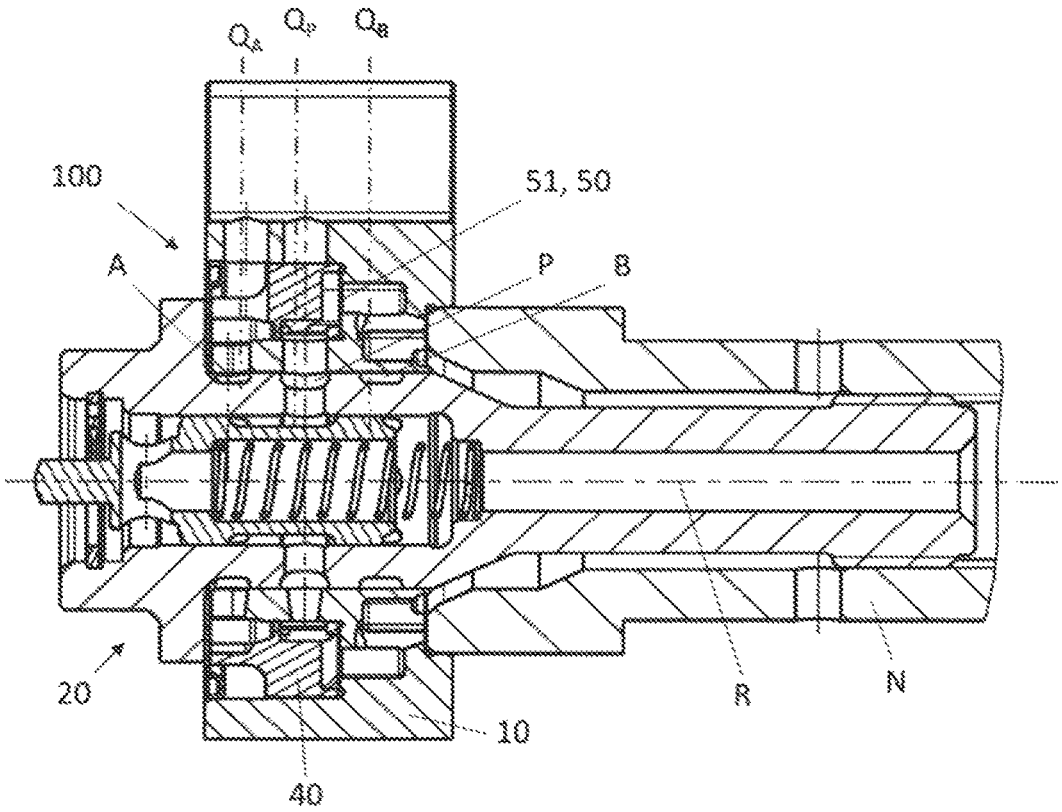
FIG. 17 the rotor unit of the first example embodiment, as in FIG. 2.

FIG. 17 shows the rotor unit 100 of the first example embodiment, fitted on the cam shaft N. It is the same longitudinal section as in FIG. 2. Cross-sectional planes $Q_P$, $Q_A$ and $Q_B$ which are respectively orthogonal to the rotational axis R are marked. The cross-sectional plane $Q_P$ extends through the pressure port P. The cross-sectional plane $Q_A$ extends through the working port A, and the cross-sectional plane $Q_B$ extends through the working port B. The planar valve structure 51 extends axially between the cross-sectional planes $Q_P$ and $Q_B$ and exhibits a distance of more than zero from each of the cross-sectional planes $Q_P$ and $Q_B$, at least when fluid is not flowing through it, as shown. The rotor unit 100 of the third example embodiment (FIGS. 13 and 14) and the rotor unit 100 of the fourth example embodiment (FIGS. 15 and 16) correspond in this respect to the first example embodiment.

Figure 18:
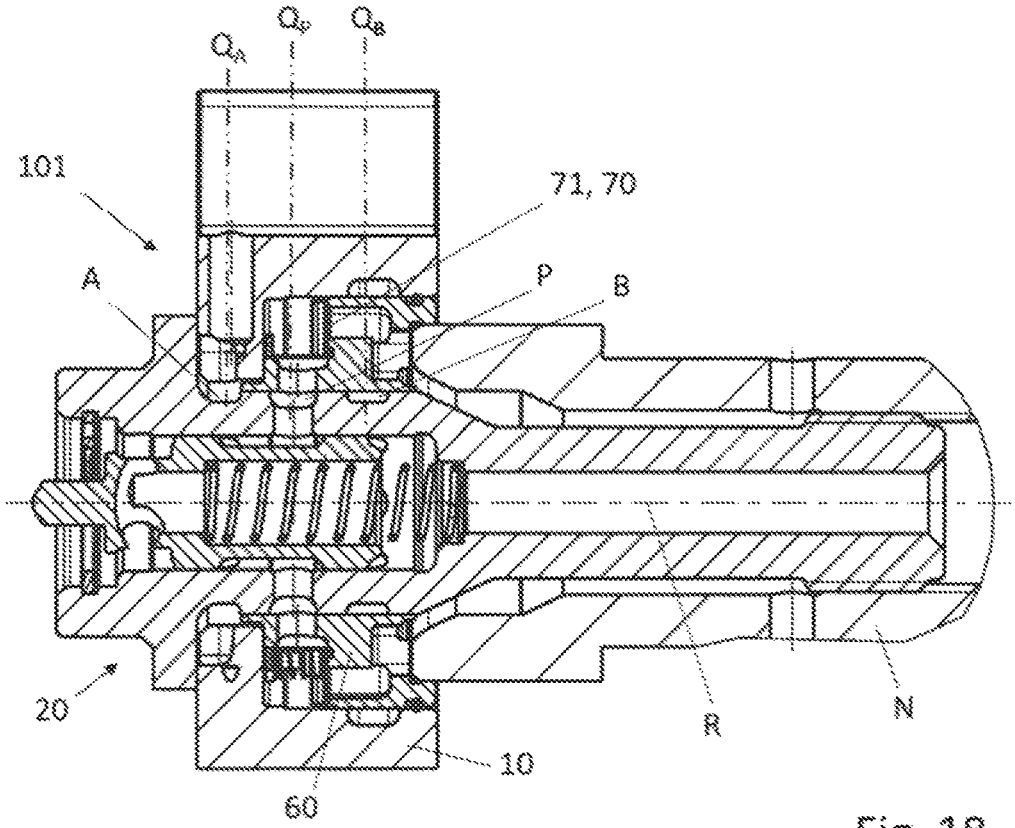
FIG. 18 the rotor unit of the second example embodiment, as in FIG. 8.

FIG. 18 shows the proportions in the longitudinal section for the second example embodiment, corresponding to FIG. 8. The valve structure 71 of the second example embodiment is also planar. As in the first example embodiment, the valve structure 71 extends axially between a cross-sectional plane $Q_P$, which intersects the pressure port P, and a cross-sectional plane $Q_B$ which intersects the working port B, each at an axial distance of more than zero.

In all the example embodiments, the pressure port P and the working ports A and B are arranged axially next to each other on an outer circumference of the control valve 20, and the pressure port P is arranged between the working ports A and B. It therefore necessarily follows that the valve structures 51 and 71 also extend axially between the respective cross-sectional planes $Q_P$ and $Q_B$.

The cross-sectional planes $Q_P$, $Q_A$ and $Q_B$ are each axially offset with respect to the axially central cross-sectional plane of the respective port P, A and B, in order to show that the characteristic of extending between the cross-sectional planes is also deemed to be fulfilled when the cross-sectional plane $Q_P$ intersects the pressure port P near its periphery, and the cross-sectional plane $Q_B$ intersects the working port B near its periphery. In the example embodiments, it advantageously holds that the respective valve structure 51 and 71 extends between two immediately adjacent cross-sectional planes $Q_P$ and $Q_B$, at least when fluid is not flowing through it. The valve structures 51 and 71 are axially offset, with no overlap, with respect to the respective pressure port P and the respective working port B, when fluid is not flowing through them.

In the first example embodiment, the feed portion 14 (FIG. 2) passes the connecting channels 16 on its way to the valve structure 51 within the rotor unit 100. In the second example embodiment, the feed portion 64 (FIG. 8) passes the connecting channels 16 on its way to the valve structure 71 within the rotor unit 101, wherein the feed channels 14*a*, 14*b* in the first example embodiment and the feed channels 64*a*, 64*b* in the second example embodiment pass the respective connecting channels 16 at an offset in a circumferential direction.

REFERENCE SIGNS

1 stator
2 stator ring
2*a* inner circumference
3 drive gear tooth system
4 stator vane
5 stator cover
6 stator cover
7 appendage
8 gasket
9 electromagnetic device
9*a* coil
9*b* plunger
9*c* spherical body
9*d* appendage
10 rotor
11 rotor hub
11*a* inner circumference
11*b* inner circumference
11*c* outer circumference
12 rotor vane
12' rotor vane
12" rotor vane
12*a* outer circumference
13 accommodating space
14 feed portion
14*a* feed channel, channel portion
14*b* feed channel, channel portion
15 feed portion
15*b* bore portion
16 connecting channel
16.1 connecting portion
16.2 connecting portion
17 connecting channel
18 inner end-facing surface of the rotor
19 accommodating space
19' inner end-facing surface of the rotor
20 control valve
21 valve housing
22 joining portion
23 collar
24 supplying portion
25 housing hollow space
26 outflow portion
27 -
28 locking pin
29 locking spring
29*a* relief channel
30 valve piston
31 valve spring
32 piston hollow space
33 control groove
34 control edge
35 control edge
36 aperture
37 -
38 -
39 cover
40 holding device
41 axial portion
41*a* inner circumference
41*s* end-facing surface, end-facing side
42 axial portion
43 recess, yielding space
44 deflecting portion
44*a* inflow region
44*b* outflow region
45 contact surface
46 connecting portion
47 equalising structure
48 filter engaging structure
49 valve engaging structure
50 reflux valve device
51 valve structure
52 spring tongue
52*a* ring
53 clearance
54 engaging structure
55 dirt filter

56 filter screen
57 supporting structure
58 engaging structure
59 -
60 holding device
60*a* inner circumference
60*s* end-facing surface
61 axial portion
61*a* equalising structure
62 axial portion
63 contact surface
64 feed portion
64*a* feed channel, channel portion
64*b* feed channel, channel portion
65 deflecting portion
66 feed portion
67 connecting portion
68 filter engaging structure
69 valve mount
70 reflux valve device
71 valve structure
72 complementary guiding element
73 reflux valve spring
74 guiding element
75 counter bearing
76 holding element
77 rigidifying periphery
78 -
79 -
80 dirt filter
81 filter screen
82 supporting structure
83 recess
84 -
85 storage feed channel
86 channel portion
87 channel portion
88 channel portion
89 -
90 pressure storage
91 storage space, pressure volume
92 storage space, relief volume
93 pressure storage piston
94 pressure storage spring
95 storage feed channel
96 channel portion
97 channel portion
98 channel portion
99 storage relief channel
100 rotor unit
101 rotor unit
A working port
B working port
$K_1$ pressure chamber
$K_2$ pressure chamber
LK bearing body
N cam shaft
P pressure port
$Q_A$ cross-sectional plane
$Q_B$ cross-sectional plane
$Q_P$ cross-sectional plane
R rotational axis
V supply channel

The invention claimed is:

1. A phase setter for adjusting a rotational angular position of a cam shaft relative to a crankshaft of an internal combustion engine, the phase setter comprising:

(a) a stator for rotary-driving the phase setter using the crankshaft;

(b) a rotor configured to rotate relative to the stator about a rotational axis and coupled to the cam shaft so as to drive the cam shaft, and which together with the stator forms a first pressure chamber and a second pressure chamber configured to be charged with a pressure fluid so as to adjust the rotor relative to the stator about the rotational axis;

(c) a control valve featuring a pressure port, a first working port and a second working port for the pressure fluid;

(d) a feed for an inflow of the pressure fluid to the pressure port, a first connecting channel for connecting the first pressure chamber to the first working port, and a second connecting channel for connecting the second pressure chamber to the second working port;

(e) and a reflux valve device which acts in the feed and comprises a valve structure which extends annularly around the rotational axis and the reflux valve device is a constituent of a rotor unit comprising the rotor, and the valve structure comprises one or more axially movable spring tongues or the valve structure is configured to be axially moved so as to restrict a backflow of the pressure fluid through the feed more than the inflow of pressure fluid to the pressure port, (f1) wherein the valve structure is positioned in a space between a cylinder defined by the pressure port and a cylinder defined by the second working port, when the pressure fluid is not flowing through the valve structure.

2. The phase setter according to claim 1, wherein the feed passes the second connecting channel at an offset in a circumferential direction.

3. The phase setter according to claim 1, wherein the first connecting channel and the second connecting channel are axially spaced from each other, and the valve structure is positioned in a space between a cylinder defined by the first connecting channel and a cylinder defined by the second connecting channel, when the pressure fluid is not flowing through the valve structure.

4. The phase setter according to claim 1, wherein the feed is deflected towards the rotational axis by the valve structure such that the pressure fluid flows off from the valve structure towards the rotational axis.

5. The phase setter according to claim 1, further comprising a holding device which extends around the rotational axis and holds the valve structure on an inner end-facing support surface of the rotor unit and which is a constituent of the rotor unit.

6. The phase setter according to claim 5, wherein the valve structure comprises one or more spring tongues, and the rotor unit further comprises a respective assigned contact surface for each spring tongue, axially opposite each spring tongue, wherein each spring tongue protrudes in a circumferential direction and is elongated in the circumferential direction.

7. The phase setter according to claim 6, wherein the feed comprises an upstream feed portion which the respective contact surface axially faces across the valve structure, and the pressure fluid flowing through the reflux valve device is deflected towards the rotational axis at the one or more spring tongues and/or the respective assigned contact surface for each spring tongue.

8. The phase setter according to claim 6, wherein the respective contact surface is inclined in relation to the rotational axis, such that an axial distance between a cross-sectional plane, in which the valve structure extends, and the respective contact surface changes in a circumferential direction.

9. The phase setter according to claim 5, wherein the valve structure as a whole is axially moved back and forth between a minimum flow position, which is a blocking position for preventing backflow, and a maximum flow position, and the reflux valve device comprises one or more springs configured to generate a spring force which moves the valve structure towards the minimum flow position.

10. The phase setter according to claim 9, wherein each spring is supported on the holding device.

11. The phase setter according to claim 1, wherein the rotor unit comprises an insert which is arranged in an accommodating space of the rotor, which extends around the rotational axis, and delineates the feed and delineates at least one of the first and second connecting channels and separates said at least one of the first and second connecting channels from the feed, wherein the insert is a holding device.

12. The phase setter according to claim 11, wherein the feed and the at least one of the first and second connecting channels emerge in the accommodating space, and the insert separates the feed in the accommodating space from the at least one of the first and second connecting channels.

13. The phase setter according to claim 11, wherein the feed comprises an upstream feed portion, which extends through the insert, and/or downstream feed portion which extends from an inner circumference of the insert radially outwards through the insert.

14. The phase setter according to claim 11, wherein:

the rotor comprises a rotor hub, featuring an inner circumference which extends around the rotational axis and an outer circumference which extends around the inner circumference, and one or more rotor vanes, and each rotor vane protrudes radially outwards from the outer circumference of the rotor hub;

the rotor hub comprises the accommodating space which extends radially around the rotational axis between the inner circumference and the outer circumference;

a linear bore traverses the rotor hub, from the outer circumference towards the inner circumference, in a region of the accommodating space;

the linear bore comprises an outer bore portion, which extends from the outer circumference up to the accommodating space, and an inner bore portion which extends from the inner circumference up to the accommodating space and forms a feed portion of the feed; and the insert seals the outer bore portion and thus separates the outer bore portion from the feed portion of the feed.

15. The phase setter according to claim 11, wherein:

the rotor comprises a rotor hub, featuring a central axial passage and an outer circumference which extends around the central axial passage, and one or more rotor vanes, and each rotor vane protrudes radially outwards from the outer circumference of the rotor hub;

the central axial passage comprises a narrow axial portion and a wide axial portion and widens in steps from the narrow axial portion into the wide axial portion, such that an inner end-facing surface of the rotor is obtained in the central axial passage; and the wide axial portion forms the accommodating space in which the insert is arranged, wherein the insert forms an inner circumference of the rotor unit.

16. The phase setter according to claim 1, further comprising a dirt filter which is arranged in the feed and extends around the rotational axis, wherein the feed extends through the dirt filter from a radially outer side towards the rotational axis.

17. The phase setter according to claim 1, comprising:

a pressure storage comprising a storage space, which extends in the stator and around the rotational axis, and a piston configured to be moved within the storage space;

and a storage feed channel which connects a pressure volume of the storage space to the feed, wherein the storage feed channel extends through or along the rotor unit.

18. The phase setter according to claim 17, wherein the storage feed channel diverts from the feed in the rotor unit.

19. The phase setter according to claim 1, wherein the pressure port, the first working port and the second working port are arranged, axially offset with respect to each other, on a circumference of the control valve, wherein the pressure port is arranged axially between the first working port and the second working port.

* * * * *